US006514180B1

(12) United States Patent
Rawls

(10) Patent No.: US 6,514,180 B1
(45) Date of Patent: Feb. 4, 2003

(54) APPARATUS AND METHODS FOR EXERCISING USING A SKATING MOTION

(76) Inventor: R. Lee Rawls, 14019-165$^{th}$Ave. NE., Woodinville, WA (US) 98072-9074

( * ) Notice: Subject to any disclaimer, the term of this patent is extended or adjusted under 35 U.S.C. 154(b) by 0 days.

(21) Appl. No.: 09/728,664

(22) Filed: Nov. 30, 2000

(51) Int. Cl.$^{7}$ ..... A63B 69/18

(52) U.S. Cl. ..... 482/70; 482/51; 482/71

(58) Field of Search ..... 482/70, 71, 63, 482/8, 9, 4, 5, 51–54, 115, 118

(56) References Cited

U.S. PATENT DOCUMENTS

| | | | | | |
|---|---|---|---|---|---|
| 2,772,881 | A | * | 12/1956 | Fundom | 482/70 |
| 2,969,060 | A | * | 1/1961 | Swanda et al. | 482/70 |
| 4,342,453 | A | * | 8/1982 | Wagner | 482/70 |
| 5,246,412 | A | * | 9/1993 | Chen | 482/70 |

* cited by examiner

*Primary Examiner*—Jerome W. Donnelly
(74) *Attorney, Agent, or Firm*—Dorsey & Whitney LLP

(57) ABSTRACT

Apparatus and methods for exercising using skating motion are disclosed. In one embodiment, an apparatus includes a frame having left and right pedal guides, left and right pedals moveably coupled to the left and right pedal guides, and a pedal control device. The pedal control device is coupled to the left and right pedals such that as one of the left or right pedals is moved along its pedal guide, the other pedal is moved in an opposite direction along its pedal guide, and both the left and right pedals rotate in a first rotational direction. As the pedals are moved back along their respective pedal guides in opposite directions, the pedal control device simultaneously rotates the pedals in a second rotational direction. The apparatus may thereby provide an improved simulation of skating, and may increase the user's enjoyment of the exercise. The pedal control device may include a resistance device, such as an electromagnetic brake, that resists the movement of the pedals. In another embodiment, an exercise apparatus includes an elongated track member, a pedal moveably coupled to the track member, the pedal being rotatable about an axis of rotation, and a pedal control assembly coupled to the pedal. The pedal control assembly may control the movement of the pedal such that as the pedal is moved in a first direction along the track member, the pedal is rotated in a first rotational direction about the axis of rotation, and as the pedal is moved in a second direction along the track member, the pedal is rotated in a second rotational direction about the axis of rotation.

42 Claims, 16 Drawing Sheets

APPARATUS AND METHODS FOR EXERCISING USING A SKATING MOTION

TECHNICAL FIELD

The present invention relates to apparatus and methods for exercising using a skating motion.

BACKGROUND OF THE INVENTION

Skating, particularly in-line skating has become a very popular activity for sport and exercise. With other popular exercise activities, stationary exercise devices have been developed that have become as popular as the activity itself. These devices are popular and needed because they allow enthusiasts of a sport to maintain conditioning in their sport when the outdoor practice of the activity may be impractical or unsafe.

Many people prefer to exercise indoors as their primary form of physical conditioning. Persons who rely on stationary exercise to maintain their fitness level will benefit from increased interest in exercise and greater exercise enjoyment. Typically, a stationary simulation device should be designed to closely replicate the popular activity, be adjustable to the user's fitness level, be enjoyable and easy to use, and be able to accommodate a wide range of body types and sizes.

There are a number of prior art devices that attempt with varying degrees of success to meet these goals. The original skate simulator, the slideboard, is fairly well known. One example of this type of device is U.S. Pat. No. RE 34,320 to Keppler. These products have achieved significant success among skating enthusiasts. Slideboards require that a user's body travel from one edge of the device to the other during use. Slideboards are limited in their versatility, however, because they are large, require significant skating technique on the part of the user and they do not allow the user to make adjustments to the exercise (e.g. resistance, speed, distance). There is a skate technique and user style and fitness level that works quite well with the slideboard, but there are many others that do not.

U.S. Pat. No. 4,340,214 to Schutzer discloses a mechanism that is similar to skating, but attempts to resolve some of the problems associated with slideboards. The Schutzer device provides a lateral, slightly inclined track that allows an alternating leg motion similar to the slideboard. The device differs from the slideboard in that it permits the bottom of the foot to remain normal to the leg, as it does in skating. It also differs in that the body does not travel from side to side. Rather, the Schutzer device provides stays in the center which keep the user's body from moving laterally, thereby isolating the movement to the legs. The device requires less skill than the slideboard but it is still quite large and requires the user to resist the force of the exercise with the shoulder (against the stays). This is quite unnatural.

U.S. Pat. No. 4,915,373 to Walker discloses an exercise device having a bicycle-type saddle in the center, on which the user is seated while leaning against a chest pad. The user's feet are engaged with left and right tracks on either side of the saddle. The tracks are shaped to approximate a skating motion. The tracks include a power or push part and a return portion. The foot does not travel away (push) from the body along the same path that it follows while returning. The constraints on the user's upper body by the seat and chest pad are uncharacteristic of the natural skating motion and detract from the simulation, and thus, the user's enjoyment of the exercise.

U.S. Pat. Nos. 5,284,460 and 5,718,658 to Miller et. al. also disclose stationary mechanical skate simulators. The Miller devices generally allow the user to move with a motion similar to skating, however, these devices are difficult to use, largely because they require significant coordination and balance. Another problem with the Miller devices is that the muscular involvement while exercising on such devices do not closely replicate the muscle involvement experienced during actual skating, as is desired.

U.S. Pat. No. 4,781,372 to McCormack and U.S. Pat. No. 4,811,941 to Elo disclose strengthening tools for skaters having a weight stack coupled to a pair of pedals by a cable-and-pully system. The pedals slide on tracks which pivot on a frame. As the user's foot travels along the track a weight is lifted. The tracks pivot so that the muscles involved in the skating push may be strengthened. As the foot returns along the track, the weight is lowered. The combined left/right motion of these devices, however, does not replicate the natural skating motion, and there is little if any similarity between the resistance experienced on these devices and the resistance experienced while skating.

In summary, existing exercise devices that attempt to simulate a skating motion suffer from undesirable characteristics that detract from the user's enjoyment and from the utility of the devices. While some existing devices replicate the skate motion better than others, those that more closely simulate skating are difficult to learn and use, or introduce other problems. Those that do not closely simulate the skating motion fail as skaters. Thus, in spite of the fact that there are many skating devices in the prior art, there is still a need for a stationary skating apparatus that will provide a simple, easy to learn and use, close simulation of the skating motion and thereby gain popular acceptance.

SUMMARY OF THE INVENTION

The present invention is directed to apparatus and methods for exercising using a skating motion. In one aspect, an exercise apparatus in accordance with the invention includes a frame having left and right pedal guides, and left and right pedals moveably coupled to the left and right pedal guides, respectively. Each of the left and right pedals rotates about an axis of rotation projecting from an upper surface thereof. The apparatus further includes a pedal control device coupled to the left and right pedals and constraining the movement of the left and right pedals such that as one of the left or right pedals is moved in a first direction along the left or right pedal guide, the other of the left or right pedals is moved in a second direction along the other of the left or right pedal guides. The pedal control device also constrains a rotational movement of the left and right pedals such that as the one of the left or right pedals is moved in the first direction, both the left and right pedals are simultaneously rotated in a first rotational direction about the axes of rotation, and as the other of the left or right pedals is moved in the first direction, both of the left and right pedals are simultaneously rotated in a second rotational direction about the axes of rotation. The exercise apparatus thereby provides an improved simulation of the natural movements associated with skating, thereby improving the quality of the exercise and increasing the user's satisfaction and enjoyment of the exercise apparatus.

In an alternate aspect, the pedal control device includes a resistance device that resists the movement of the left and right pedals in at least one of the first and second directions. Alternately, the resistance device may include an electromagnetic brake, and may be coupled to a controller to allow the resistance of the device to be adjusted.

In yet another aspect, an exercise apparatus includes an elongated track member, a pedal moveably coupled to the track member, the pedal being rotatable about an axis of rotation, and a pedal control assembly coupled to the pedal. The pedal control assembly may control the movement of the pedal such that as the pedal is moved in a first direction along the track member, the pedal is rotated in a first rotational direction about the axis of rotation, and as the pedal is moved in a second direction along the track member, the pedal is rotated in a second rotational direction about the axis of rotation. The pedal control assembly may include a belt coupled to a rotation shaft attached to the pedal, the belt at least partially wrapping or unwrapping from around the shaft as the pedal moves in either the first or second directions. Alternately, the pedal control assembly may include a slide rod rotatably coupled to a fixed support, the slide rod slideably engaging a slide bore disposed in the pedal.

DETAILED DESCRIPTION OF THE INVENTION

The present invention is generally directed to apparatus and methods for exercising using a skating motion. Many specific details of certain embodiments of the invention are set forth in the following description and in FIGS. 1–16 to provide a thorough understanding of such embodiments. One skilled in the art will understand, however, that the present invention may have additional embodiments, or that the present invention may be practiced without several of the details described in the following description.

Figure 1:
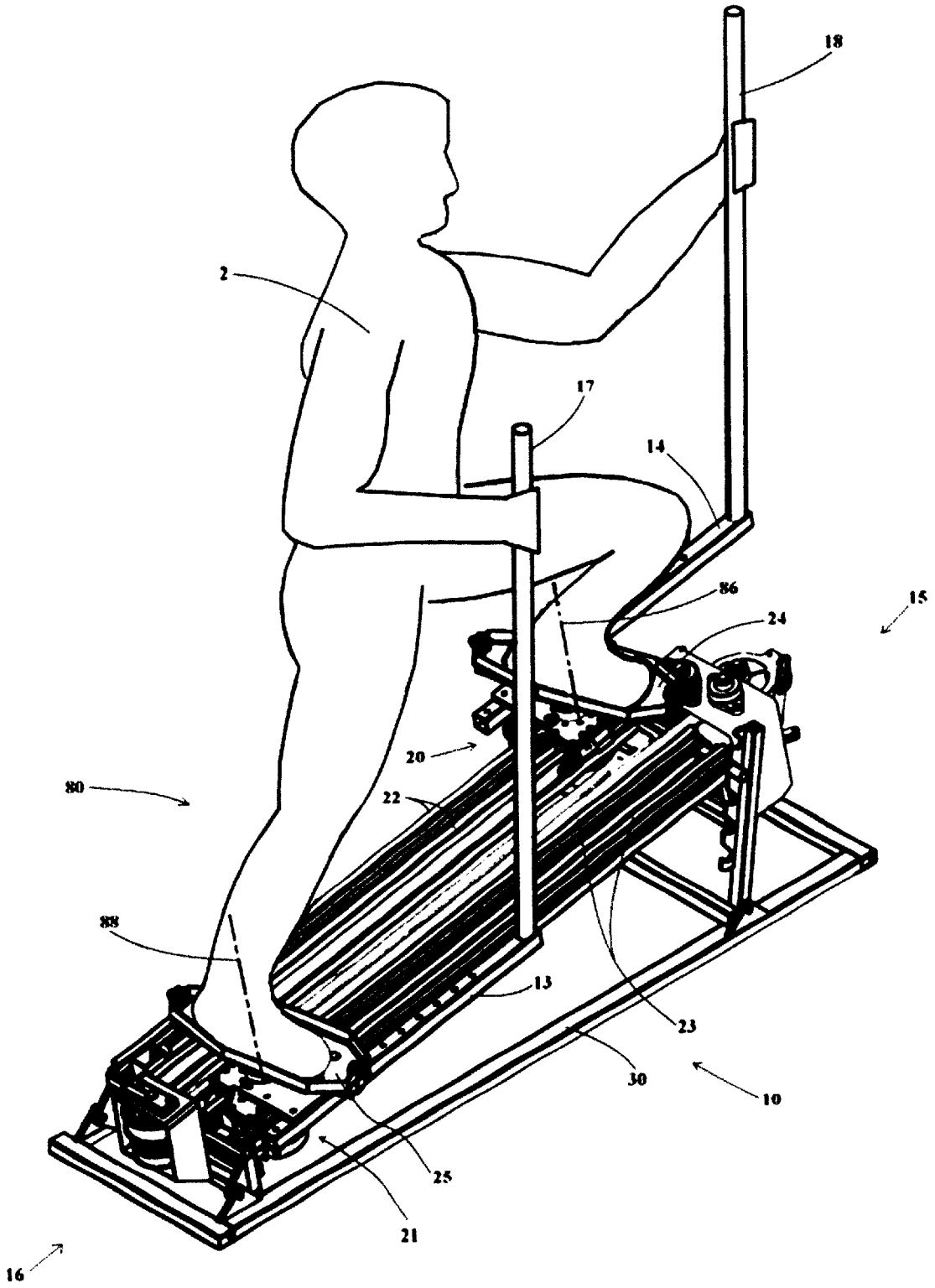
FIG. 1 is an isometric view of a user in a first position on an exercise apparatus in accordance with an embodiment of the invention.

FIG. 1 is an isometric view of a user 2 on an exercise apparatus 10 in accordance with an embodiment of the invention. As shown in FIG. 1, the exercise apparatus 10 generally includes a front end 15 and a rear end 16, and left and right pedals 24, 25. The left and right pedals 24, 25 are mounted on left and right pedal mounts 20, 21, respectively, which permit the pedals 24, 25 to be rotated, as described more fully below. The left and right pedal mount assemblies 20, 21 are moveably mounted on left and right pedal tracks 22, 23 which are inclineably attached to a base frame 30. A right handle 17 projects forward and upwardly from the right pedal mount 21 at the right handle connection 13. A left handle 18 projects froward and upwardly from the left pedal mount 20 at the left handle connection 14.

Figure 2:
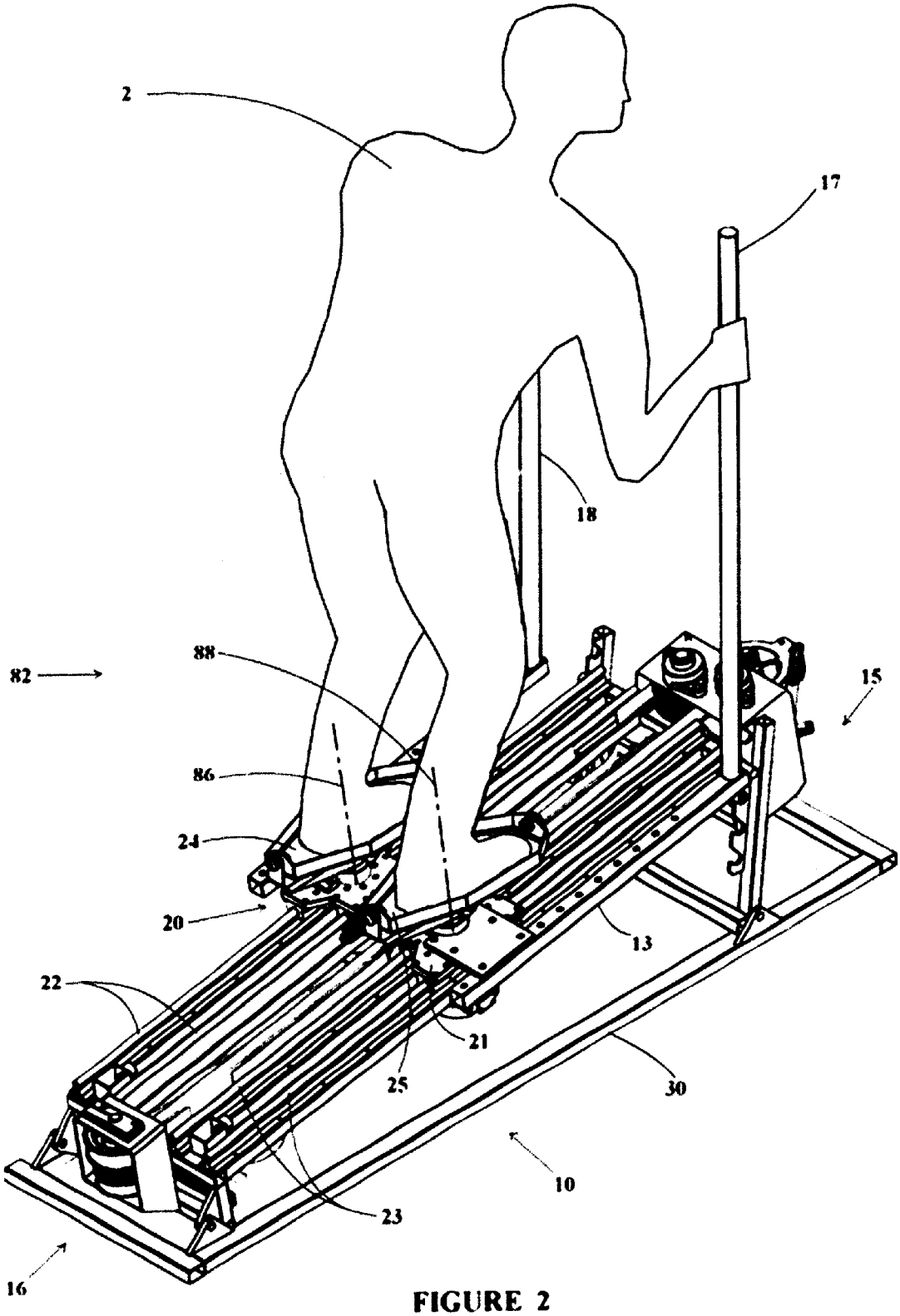
FIG. 2 is an isometric view of the exercise apparatus of FIG. 1 with the user in a second position.
Figure 3:
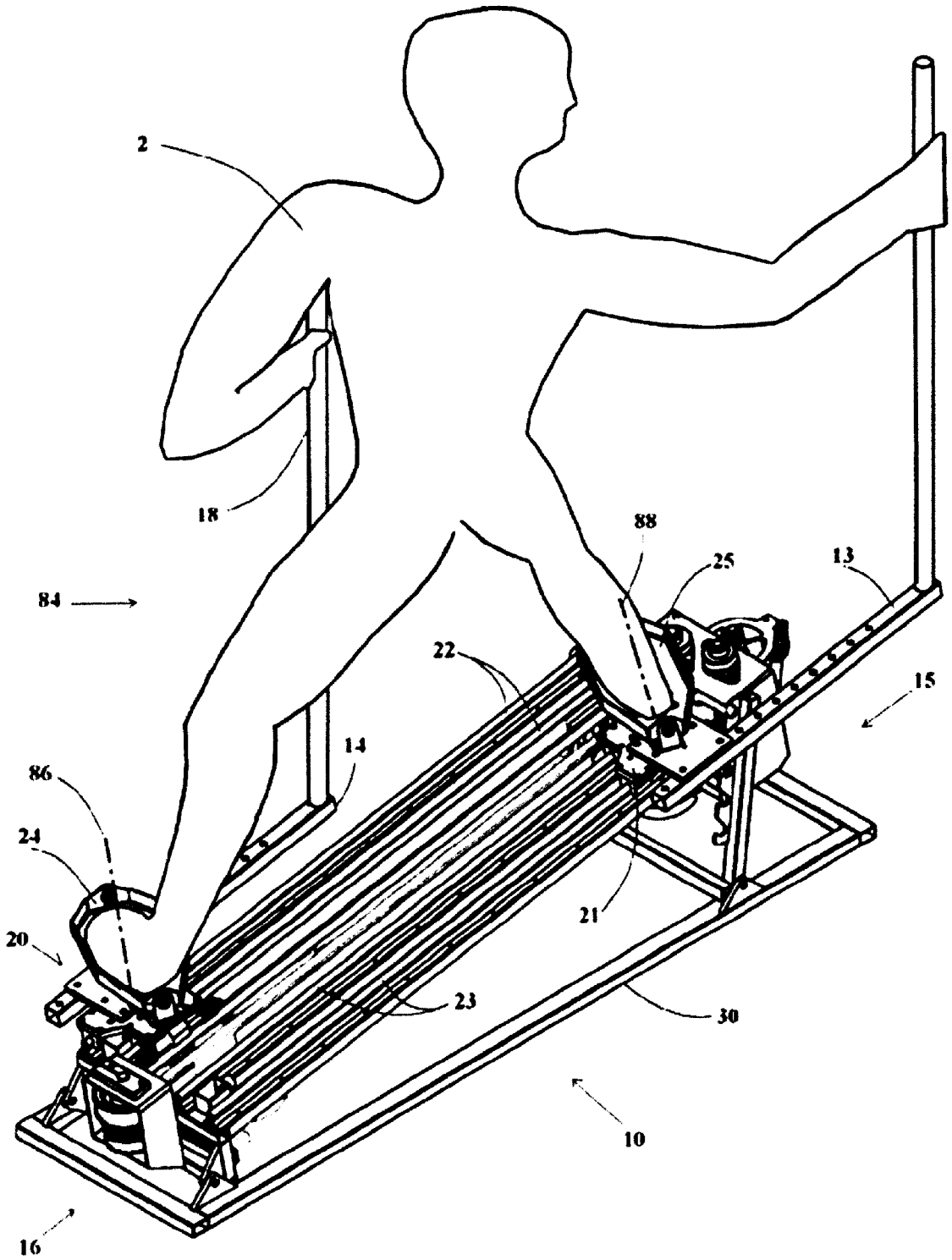
FIG. 3 is an isometric view of the exercise apparatus of FIG. 1 with the user in a third position.

FIGS. 1, 2, and 3 present isometric views of the user 2 and the exercise apparatus 10 in a series of positions illustrating the range of motion/use of the exercise apparatus 10. FIG. 1 shows the exercise apparatus 10 in a first position 80 having the right pedal 25 and right handle 17 driven towards the rear end 16 of the apparatus 10 at the limit of their rearward travel, and the left pedal 24 and the left handle 18 driven towards the front end 15 of the apparatus 10 at the limit of their forward travel. In the first position 80, each pedal is rotated clockwise about an axis of rotation 86, 88 that projects upwardly from an upper surface of each pedal through the user's foot. The user 2 is also rotated somewhat to the right. The user's left hand is shown in FIG. 1 as being in contact with the left handle 18 and the right hand is in contact with right handle 17 for stability.

FIG. 2 shows the exercise apparatus 10 in a second or "middle" position 82 of its range of motion. In this position, both pedals 24, 25 and handles 17 and 18 are approximately in the middle of the pedal tracks 22, 23 and the pedals 24, 25 are centered in their rotation about the axes 86, 88 (i.e. both feet are pointed toward the front end 15 of the exercise apparatus 10) and the user 2 is facing forward. As shown in FIG. 2 the user's hands are in contact with handles 17 and 18 for stability.

FIG. 3 shows the exercise apparatus 10 in a third position 84 having the left pedal 24 and left handle 18 driven toward the rear end 16 of the apparatus 10 at the limit of their rearward travel, and the right pedal 21 and right handle 17 driven toward the front end 15 of the apparatus 10 at the limit of their forward travel. In the third position 84, both pedals 24, 25 are rotated counterclockwise about the axes of rotation 86, 88. The user 2 is rotated somewhat to the left. The user's right hand is in contact with the handle 17 for stability. Normal use of the apparatus involves continuous and repeated pedal strokes (right pedal back followed by left pedal back) as described above.

Figure 4:
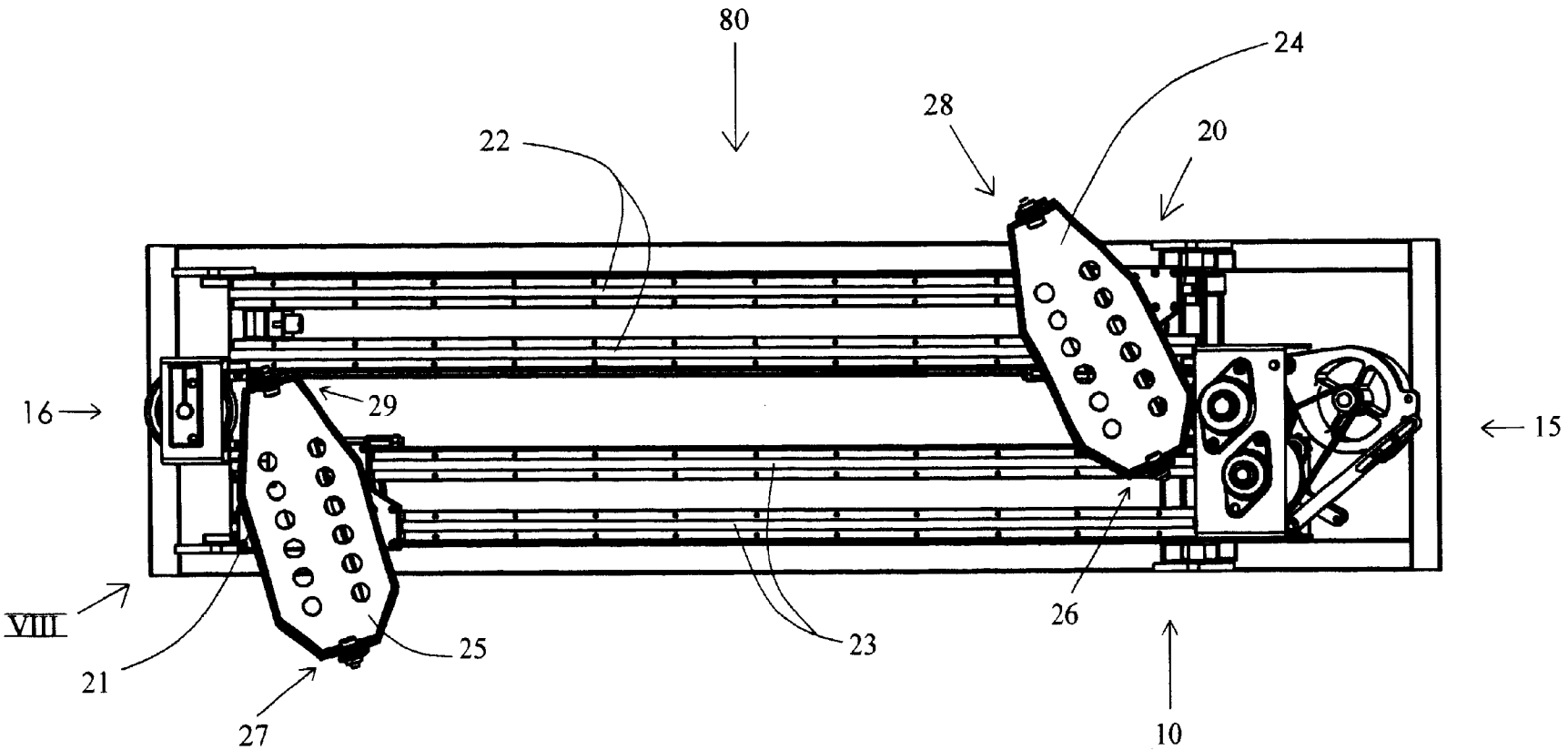
FIG. 4 is a top plan view of the exercise apparatus of FIG. 1 with the handles removed.
Figure 5:
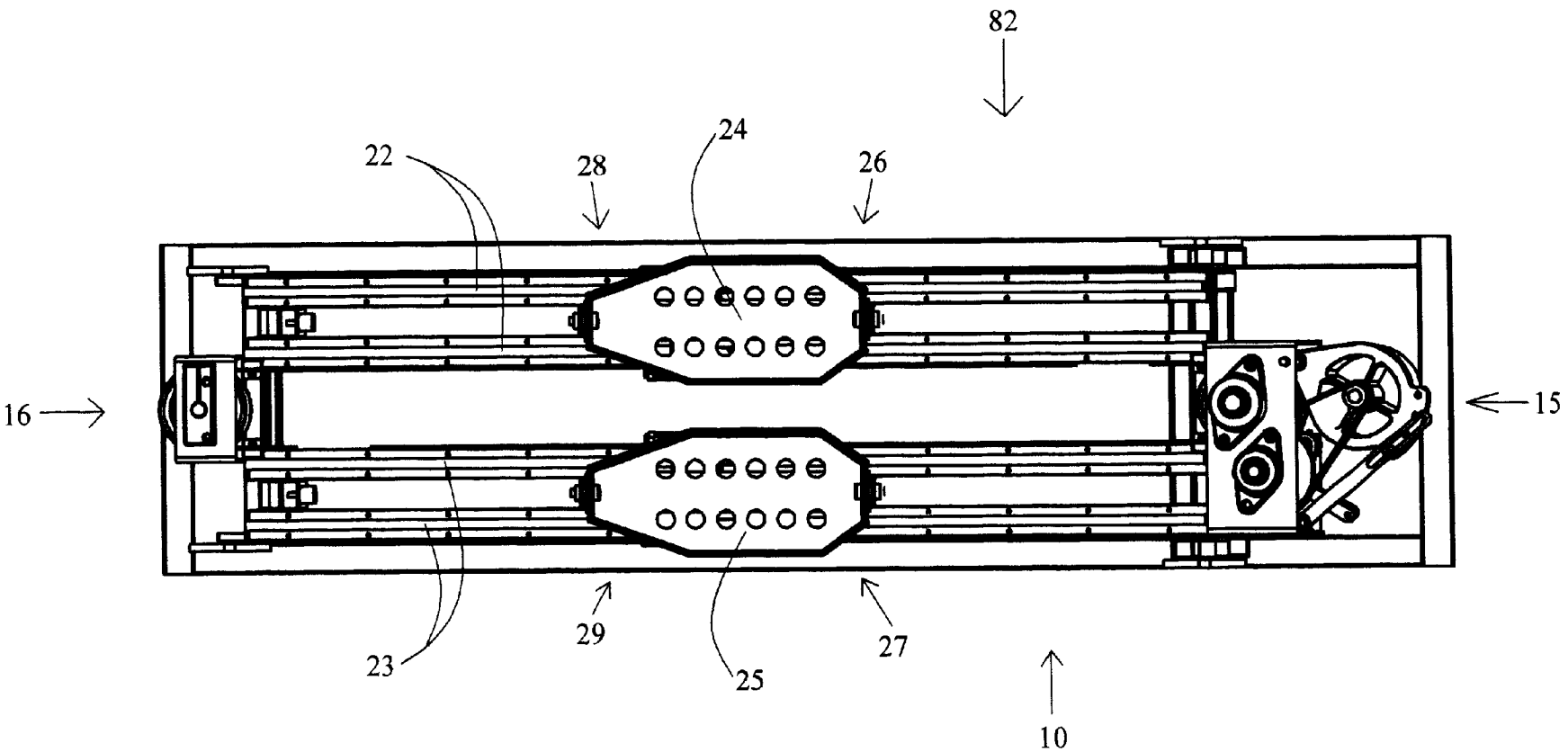
FIG. 5 is a top plan view of the exercise apparatus of FIG. 2 with the handles removed.
Figure 6:
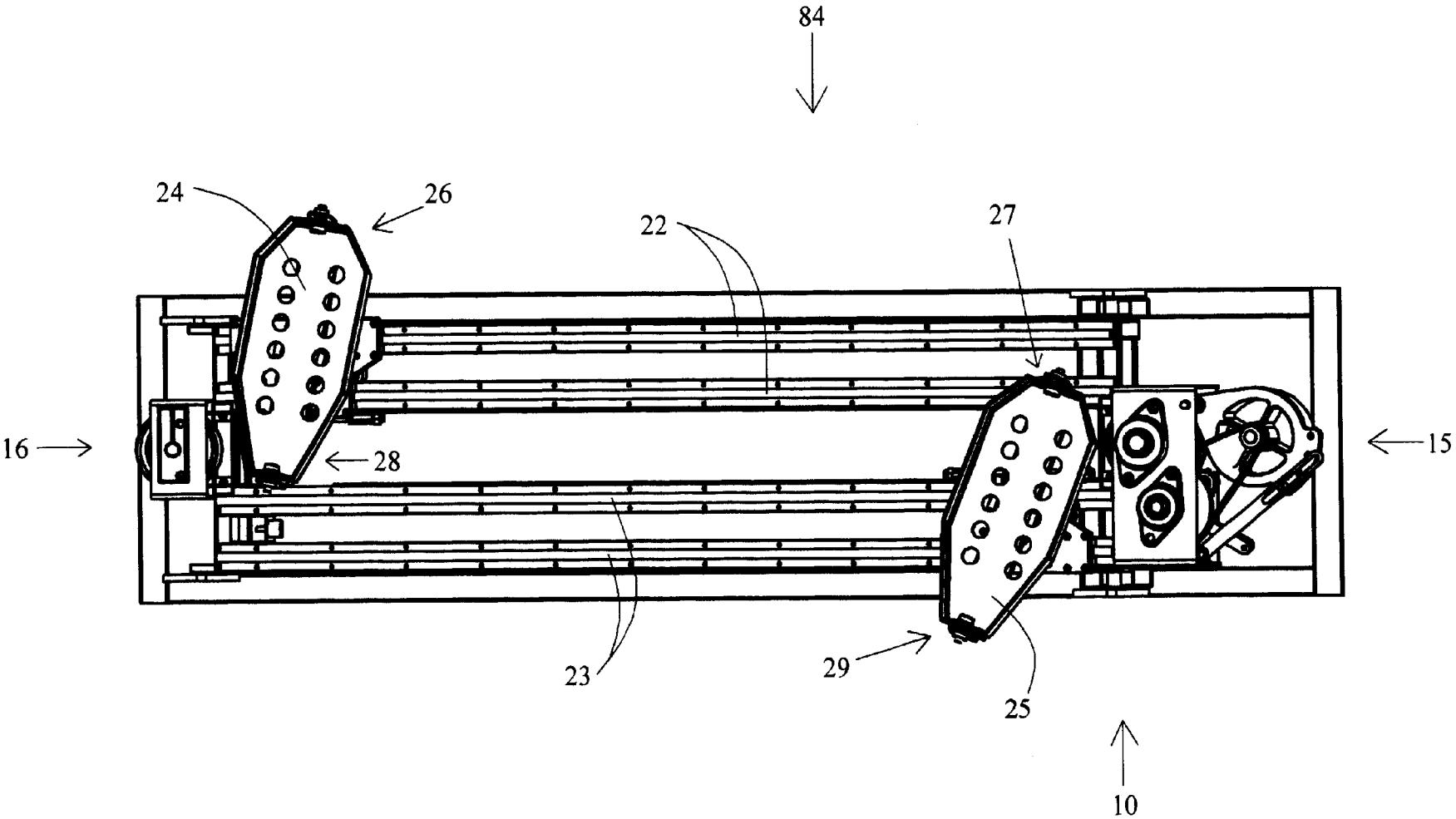
FIG. 6 is a top plan view of the exercise apparatus of FIG. 3 with the handles removed.

It should be noted that the handles 17 and 18 support the user throughout the motion of the exercise. Because the handles are attached directly to the pedal mounts 20 and 21, the movement of the handles corresponds directly with the movement of the pedals, forcing the upper body to rotate along with the feet that are located on the rotating pedals. FIGS. 4, 5 and 6 are top plan views of the exercise apparatus 10 in the first, second, and third positions 80, 82, 84 with the handles 17 and 18 removed. As shown in these figures, the left and right pedal mount assemblies 20, 21 may be moved along the left and right pedal tracks 22, 23, respectively. The left and right pedal tracks 22, 23 define left and right pedal paths. The left and right pedals 24, 25 each have a forward end 26, 27, respectively, to receive a toe portion of the user's foot, and a rearward end 28, 29, respectively, to receive a heel portion of the user's foot.

In operation, the exercise apparatus 10 allows the user 2 to exercise by standing on the exercise apparatus 10 and moving the legs and feet in a motion simulating the motion of skating. The user 2 stands on the exercise apparatus 10, placing his or her feet on the left and right pedals 24, 25. The user may begin exercising from, for example, the middle position 82 shown in FIG. 2. From the middle position 82, the user 2 may drive the right pedal 25 along the right track 23 toward the rear end 16, simulating a pushing or driving stroke of the skating motion. Simultaneously, the left pedal 24 advances forward in the left track 22 toward the front end 15, and the left and right pedals 24, 25 automatically rotate in a clockwise direction (as viewed from above) about the axes 86, 88. The mechanisms that control the rotation of the pedals 24, 25 are described more fully below. Eventually, the right pedal 25 may reach the end of the right track 23 and the left pedal 24 may reach its most forward position, as shown in FIG. 1.

After the push stroke using the right leg, the user 2 may draw the left pedal 24 backwardly along the left track 22 and the right pedal 25 forwardly along the right track 23, passing at least momentarily through the middle position 82 shown in FIG. 2. During this portion of the skating movement, the pedals 24, 25 automatically rotate in a counterclockwise direction about the axes 86, 88. From the middle position 82, the user may begin the next push stroke by driving the left pedal 24 along the left track 22 toward the rear end 16. Simultaneously, the right pedal 25 advances in the right track 23 toward the front end 15, and the pedals 24, 25 rotate in a counterclockwise direction about the axes 86, 88. The movement of the pedals 24, 25 may continue in this manner until the exercise apparatus reaches the third position 84 (FIG. 3), completing the push stroke with the left leg.

From the third position 84, the user 2 may draw the left pedal 24 in a forward direction along the left track 22 and the right pedal 25 in a backward direction along the right track 23, causing the pedals 24, 25 to simultaneously rotate in the clockwise direction and returning the exercise apparatus 10 to the middle position 82. When the user arrives at the middle position 82, one full cycle of the skating motion has been completed. The user may continuously repeat the above-described full cycle of skating motion as long as desired.

The exercise apparatus 10 advantageously allows the user to exercise using any desired skate/pedal stroke length by simply moving the user's legs any desired length of travel (limited only by the length of the tracks). The exercise apparatus 10 may thereby accommodate a variety of stroke lengths of the user and even allows the user to change the length of the stroke while an exercise is in progress without requiring any adjustment by the user of equipment settings. The exercise apparatus 10 automatically and immediately causes the pedal to rotate in response to the stroke length (pedal travel) used by the user during the exercise and allows a broad range of variability of the pedal travel throughout a large stroke length range at any time during the exercise. In this embodiment, pedal rotation is linked to pedal travel throughout the range of motion of the pedal. As used herein, stroke length refers to the total pedal travel defined as the distance between the rearward and forward end extents of travel of the pedals of the apparatus during a full cycle. The result is an exercise apparatus with improved construction and feel, and greater flexibility and ease of operation, which may simulate a skating type motion that closely matches the natural skating movements for the user.

Figure 7:
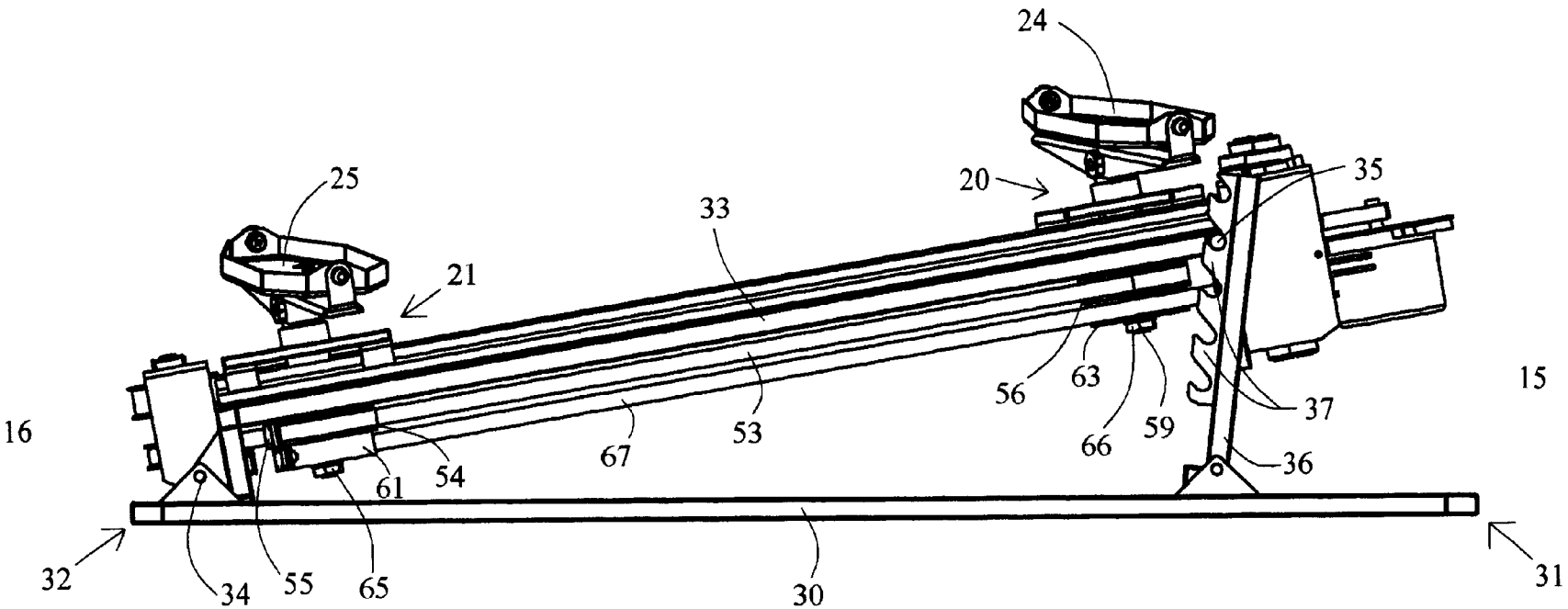
FIG. 7 is a side elevational view of the exercise apparatus of FIG. 1 with the handles removed.

FIG. 7 is a side elevational view of the exercise apparatus 10 of FIG. 1 with the handles 17 and 18 removed. In this view, one can see that the base frame 30 provides support for the other components of the apparatus 10 and rests on the floor during use. The base frame 30 has a front end 31 and a rear end 32. An incline control member 36 having a plurality of catches 37 is attached to, and projects upwardly from, the front end 31 of the base frame 30. An upper frame 33 supports the left and right tracks 22, 23 and is pivotably coupled to the base frame 30 at a frame hinge point 34. The upper frame 33 includes an elevation bar 35 that releaseably engages the incline control member 36.

In operation, the upper frame 33 may be adjustably positioned over a range of incline angles by engaging the elevation bar 35 with the catches 37 of the incline control member 36. The incline control member 36 creates a stable, inclined working angle along which the pedal tracks 22, 23 are disposed. Thus, the user may increase or decrease the inclination angle of the pedal tracks 22, 23 as desired to increase or decrease the amount of exertion the user applies during the push stroke of the skating motion.

It will be clear to those experienced in the art that there are many possible methods for controlling and/or adjusting the working angle of the pedal tracks. A wide variety of mechanisms could be used to manually or non-manually adjust the inclination of the tracks, including, for example, jack-screws, hydraulic or pneumatic pistons, ratchet-type jacks, or other various actuating mechanisms. Such mechanisms may be actuated by a motor, which would allow controllable adjustment of the working angle of the tracks and would allow the track angle to be adjusted during use.

Although the left and right pedal tracks 22, 23 shown in FIGS. 4–7 are linear and parallel, other embodiments could include non-linear and/or nonparallel left and right pedal tracks. It should also be noted that while the pedal tracks 22, 23 are shown as being in a plane, in alternate embodiments, the pedal tracks need not lie in a plane. In order to more finely adjust the foot travel path, or to achieve a different feel or motion, it is anticipated that track paths could deviate in many ways from the parallel paths lying in an inclined plane as shown in the accompanying figures.

Figure 8:
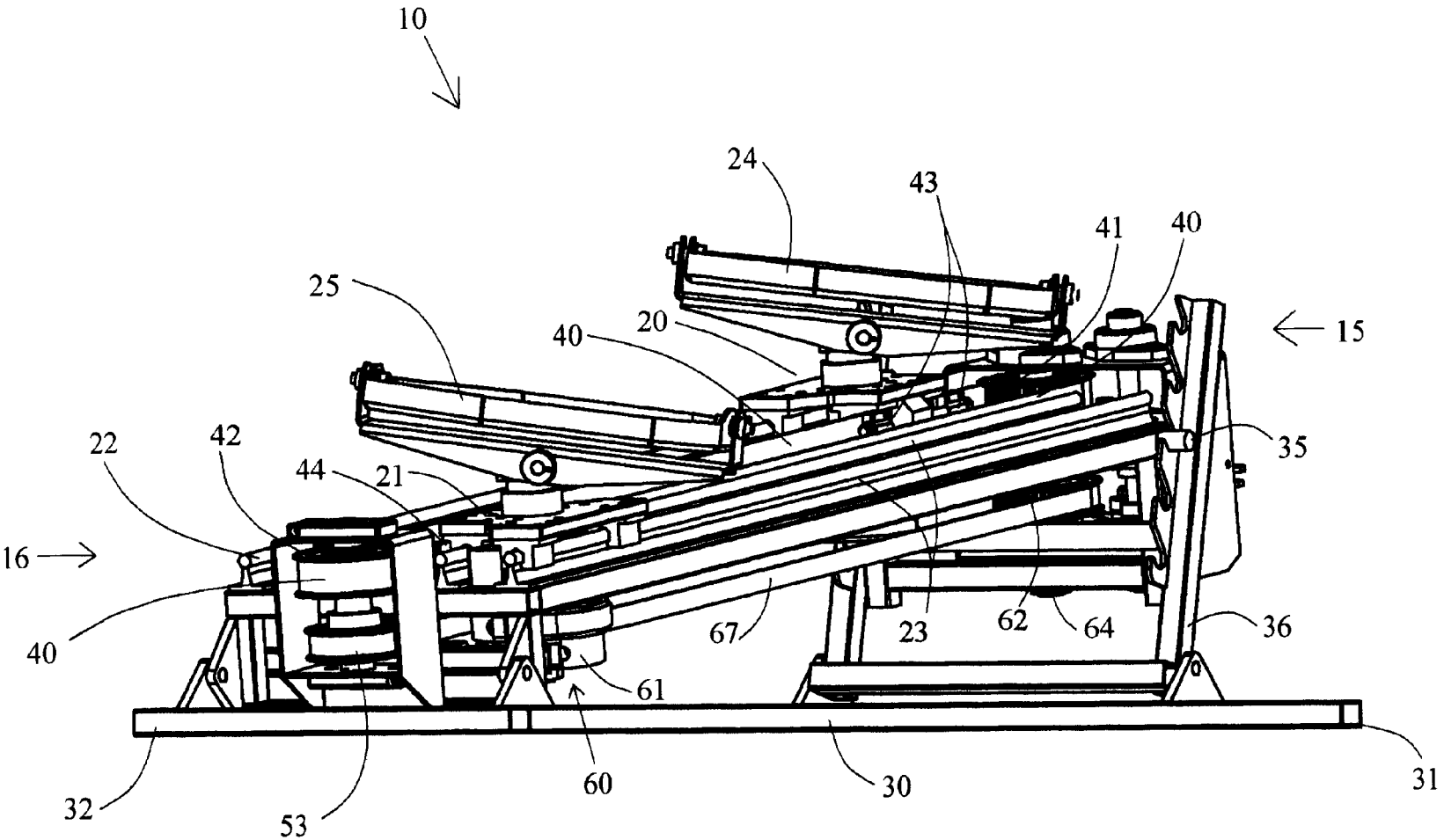
FIG. 8 is an isometric view of the exercise apparatus of FIG. 4 as viewed along arrow VIII.
Figure 9:
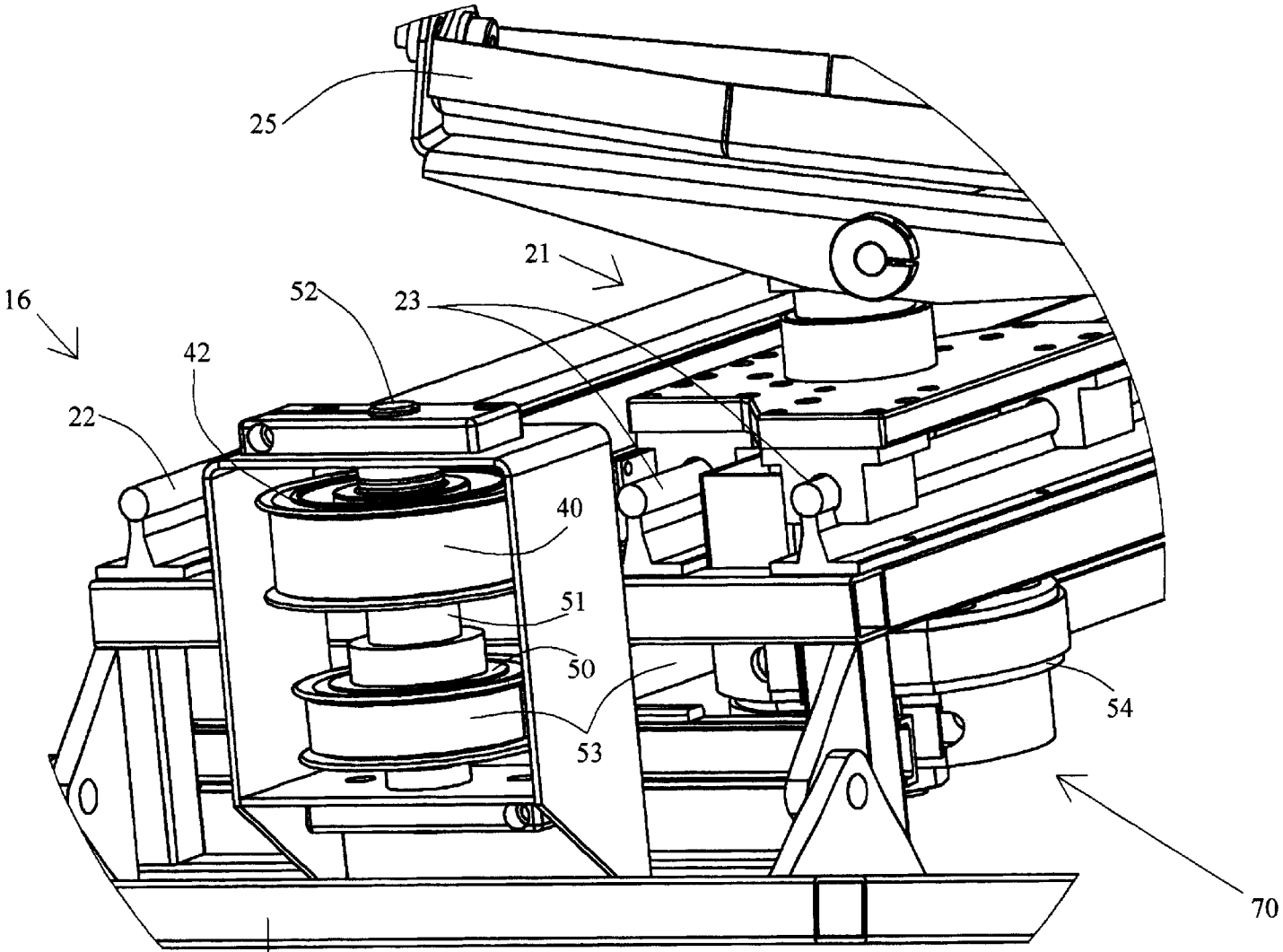
FIG. 9 is an enlarged partial isometric view of the exercise apparatus of FIG. 8.

FIG. 8 is an isometric view of the exercise apparatus 10 as viewed along arrow VIII in FIG. 4. FIG. 9 is an enlarged partial isometric view of the exercise apparatus 10 of FIG. 8. As shown in FIG. 8, a pedal control assembly 60 is partially shown that controls the movement and rotation of the pedals 24, 25. The pedal control assembly 60 includes the left and right pedal mount assemblies 20, 21 and the left and right pedal tracks 22, 23, which were discussed above. The pedal control assembly 60 further includes a drive belt 40 that engages about a transmission input drive pulley 41 and a rear drive pulley 42.

In this embodiment of the pedal control assembly 60, the drive belt 40 is connected to the left and right pedal mount assemblies 20, 21 by clamp/tensioning devices 43, 44, respectively. The drive belt 40 forms a continuous loop linking the two pedal mount assemblies 20, 21 together. The result is that, in this embodiment, neither pedal mount assembly can move independently of the other, and movement of one pedal mount assembly along its associated pedal track causes reciprocal movement of the other pedal mount assembly along the other pedal track. When the right pedal assembly 21 travels from the front end 15 of the apparatus to the rear end 16 of the apparatus, the drive belt 40 is driven in a generally clockwise direction about the input drive pulley 41 and the rear drive pulley 42. Conversely, when the left pedal mount assembly 20 travels from the front end 15 to the rear end 16, the drive belt 40 is driven in a generally counterclockwise direction about the drive pulleys 41, 42. Thus, the drive belt 40 engages the input drive pulley 41 and the rear drive pulley 42 in reciprocal (clockwise/counterclockwise) motion as the user 2 makes repeated, alternating pedal strokes.

As best shown in FIG. 9, the left and right pedal tracks 22, 23 include pairs of supported, round rods that act as linear bearings. Those of ordinary skill in the art will understand, however, that there are many alternate ways to design and built tracks which guide and support the movement of the pedal mount assemblies 20, 21 including, for example, using wheels or rollers as guides along a linear or shaped extruded channel. A wide variety of other equivalent track devices are known and/or commercially available.

Figure 10:
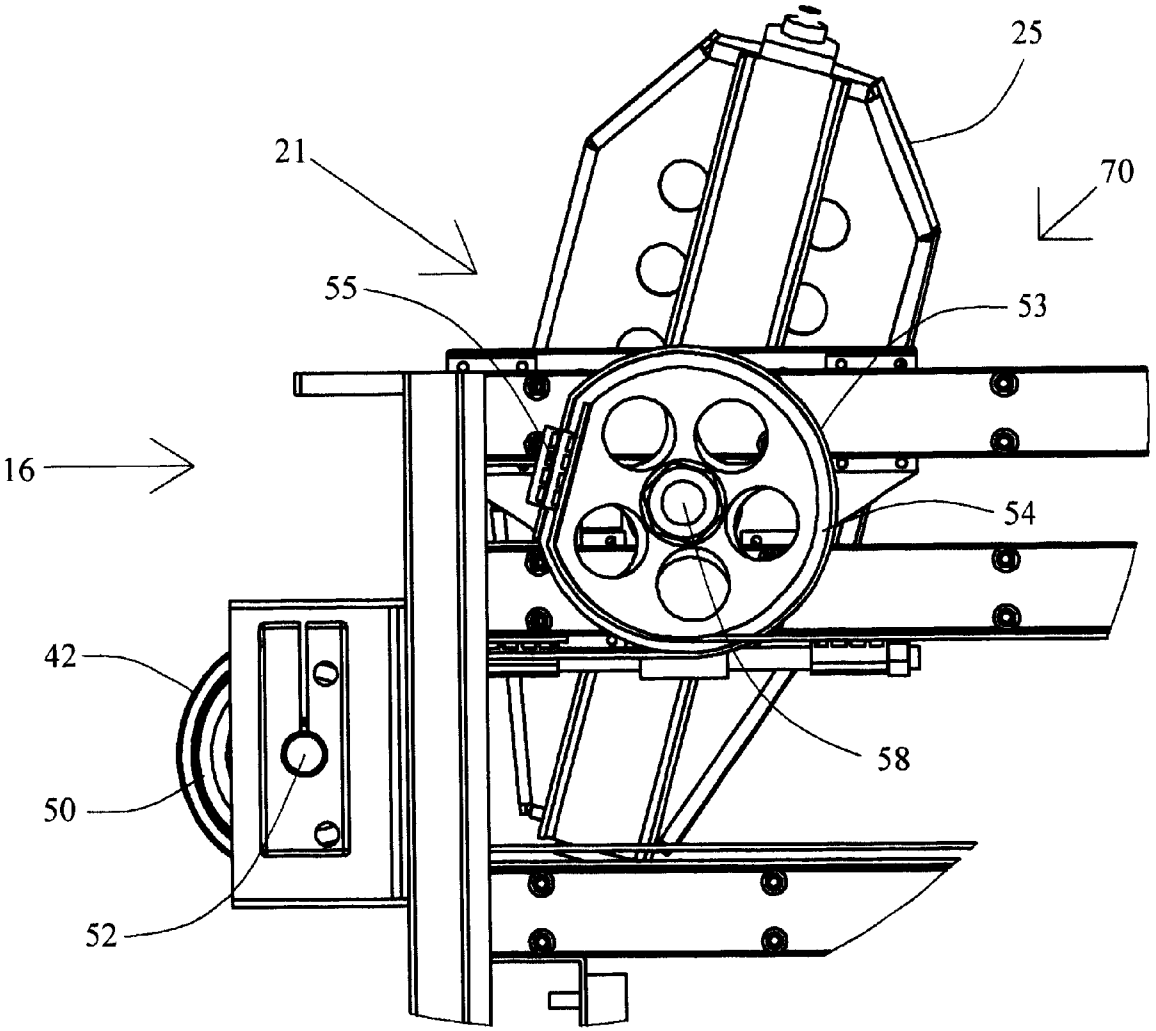
FIG. 10 is a partial bottom plan view of the exercise apparatus of FIG. 1.

FIG. 10 is a bottom plan view of the exercise apparatus 10 of FIG. 8. As shown in FIGS. 9 and 10, the exercise apparatus 10 includes a pedal rotation control assembly 70 having a spin control pulley 50 rigidly connected to the rear drive pulley 42 by a rear torque transfer tube 51. The rear torque transfer tube 51 may spin on bearings (not shown) about a rear support shaft 52. A spin control belt 53 is engaged about the spin control pulley 50, and has a right end attached to a right pedal spin pulley 54 of the right pedal mount assembly 21, and a left end attached to a left pedal spin pulley 56 (visible in FIG. 7) of the left pedal mount assembly 20. The ends of the spin control belt 53 are attached to the pedal spin pulleys 54, 56 using clamp members 55 (FIG. 10). The right pedal spin pulley 54 is attached to the right pedal 25 by a right pedal shaft 58, and the left pedal spin pulley 56 is attached to the left pedal 24 by a left pedal shaft 59 (FIG. 7). The spin control belt 53 is fixed at one end to the right pedal spin control pulley 54, is engaged about the spin control pulley 50, and is fixed at the other end to the left pedal spin control pulley 56.

As described above, the drive belt 40 is engaged with the rear drive pulley 42, causing the rear drive pulley 42 to rotate about the rear support shaft 52 as the drive belt 40 is moved back and forth by the movement of the pedals 24, 25. Rotation of the rear drive pulley 42 causes the rear torque transfer tube 51 to rotate, which causes the spin control pulley 50 to rotate at the same angular rate as the rear drive pulley 42. Thus, as the rear drive pulley 42 is rotated by the drive belt 40, the spin control belt 53 is driven by the spin control pulley 50, causing the left and right pedal spin pulleys 56, 57 to rotate the pedals 24, 25. More precisely, rearward movement of the right pedal mount assembly 21 along the right track 23 causes movement of the drive belt 40, which in turn causes clockwise rotation of the rear drive pulley 42. The rear drive pulley 42 is driven to rotate clockwise through an angular displacement such that the circumferential distance traveled by the rear drive pulley 42 is equal to the distance traveled by the drive belt 40. Clockwise rotation of the rear drive pulley 42 causes a corresponding clockwise rotation of the spin control pulley 50. Both pulleys 42 and 50 rotate together through the same angular displacement.

In the embodiment shown in the accompanying figures, the spin control pulley 50 has a smaller diameter and therefore a smaller circumference than rear drive pulley 42. Rotation of the spin control pulley 50 through the same angular displacement as the rear drive pulley 42 will result in less circumferential distance traveled by the circumference of the spin control pulley 50 than the distance traveled by the drive belt 40 that caused the rear drive pulley 42 rotation. Because of this difference in the distance traveled about the circumference of the rear drive pulley 42 and the spin control pulley 50, the drive belt 40 and the spin control belt 53 do not travel at the same linear rate. In the embodiment shown in the accompanying figures, the spin control belt 53 will travel slower than drive belt 40. The consequences of this difference will now be described with reference to FIG. 10.

As the right pedal mount assembly 21 travels toward the rear end 16, the drive belt 40 travels the exact same distance as the right pedal mount assembly 21. The spin control belt 53, however, travels a shorter distance than the drive belt 40. Because both belts are attached to the right pedal mount assembly 21, as the assembly moves, the spin control belt 53 must be "lengthened" in order that it can remain attached to the right pedal mount assembly 21. The additional length is provided by the rotation of the pedal shaft 58 on which the right pedal spin control pulley 54 and the right pedal 25 are mounted. As viewed in FIG. 10, the right pedal spin control pulley 54 will rotate clockwise (counterclockwise in all other views), thus lengthening the section of the spin control belt 53 between the right pedal assembly 21 and the spin control pulley 50. In this way, the pedal rotation is controlled as a function of the travel of the right and left pedal mount assemblies 20, 21 along their respective tracks. The amount of rotation per unit of pedal mount assembly travel is determined by the ratio of the diameters of the rear drive pulley 42 and the spin control pulley 50. The rotation rate of the pedals 24, 25 may be altered by changing this ratio.

In this embodiment, the spin control belt 53 will not remain in tension without an additional belt maintaining tension towards the front end 15 of the exercise apparatus 10. A spin tension belt 67 maintains the desired belt tension (see FIGS. 7 and 8). The spin tension belt 67 is fixed at one end to the right pedal tension pulley 61. As best viewed in FIG. 8, the spin tension belt 67 then engages and wraps around a tension idler pulley 62 mounted on the upper frame 33 near the front end 15, and is fixed at the other end to the left pedal tension pulley 63. The tension idler pulley 62 spins freely about the input drive shaft 64 (FIG. 8).

Tension is maintained in the spin tension belt 67 by locking the right and left pedal spin control pulleys 54, 56 to the right and left pedal tension pulleys 61, 63 (FIG. 7) by tightening right and left spin pulley lock nuts 65, 66. Before the locking nuts 65, 66 are tightened, the left and right pedal tension pulleys 61, 63 should be rotated relative to the left and right pedal spin control pulleys 54, 56 such that the spin control belt 53 and the spin tension belt 67 are both in tension. Once the spin pulley locking nuts 65, 66 are tightened, both belts 53, 67 will remain in tension.

Although the rotation of the pedals is coupled to the travel of the pedals along the left and right tracks in the above-described embodiment of the exercise apparatus 10, in alternate embodiments, the rotation of the pedals may be decoupled from the movement of the pedals along the tracks. For example, the pedal rotation control assembly 70 may be disabled in some manner, such as by disengaging the rear torque transfer tube 51. With the rear torque transfer tube 51 disabled, the resulting embodiment of an exercise apparatus may be used with no pedal rotation, simulating, for example, a cross country skiing type of motion. Alternately, the resulting apparatus may be used with some other rotation as desired by the user. With the rear torque transfer tube 51 disabled, the rotation of the left and right pedals 24, 25 would remain coupled (i.e. either both rotate or do not rotate), however, the rotation of the pedals would be independent from the travel of the pedals on the tracks.

In alternate embodiments, the pedal rotation control assembly 70 may be selectively disengageable so the user may alternate between modes of operation of the exercise apparatus (e.g. skating motion or cross country skiing motion), or the pedal rotation control assembly 70 could be eliminated, and the pedals could be freely and independently rotatable, or even fixed and non-rotatable. In yet other embodiments, separate pedal rotation control assemblies could be provided for each of the pedals 24, 25 so that the rotation of one pedal may be controlled independently from the other pedal. Independent rotational control of each pedal may, for example, provide an improved simulation of various skating conditions, such as skating around a turn or speed-skating around a circular or oval-shaped track, in which one of the user's legs moves along a longer stroke and undergoes a greater amount of rotation.

Figure 11:
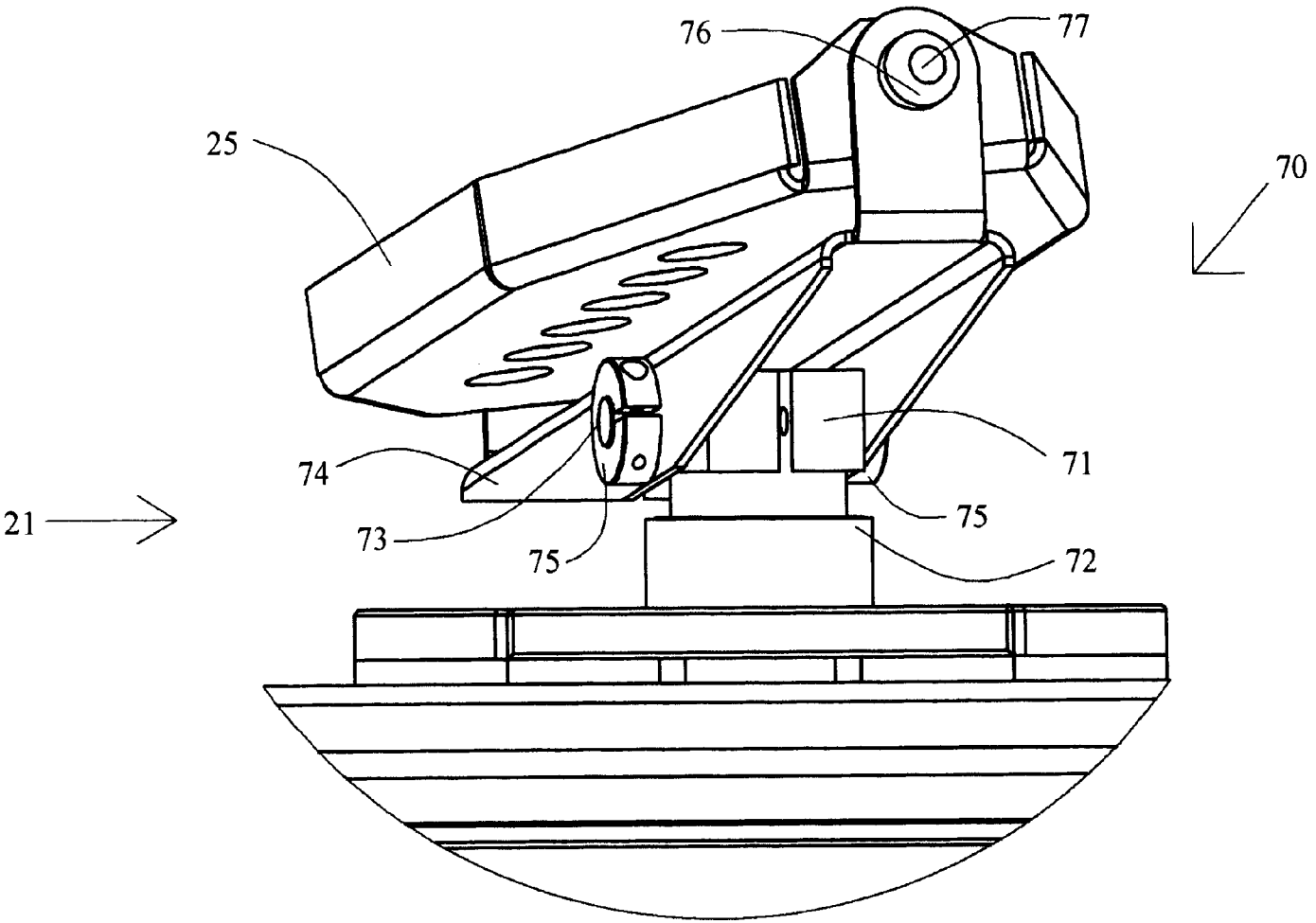
FIG. 11 is an enlarged partial isometric view of an embodiment of a right pedal mount assembly of the exercise apparatus of FIG. 1.

FIG. 11 is an enlarged partial isometric view of an embodiment of the right pedal mount assembly 21 of the exercise apparatus 10 of FIG. 1. A right pivot member 71 is mounted on the right pedal shaft 58 (shown in FIG. 10) which rotates freely on bearings within a right pedal shaft housing 72. A right pivot shaft 73 passes through the right pivot member 71 and is clamped to a right pedal bracket 74 using clamps 75. The right pivot shaft 73 rotates freely within the right pivot member 71, allowing the right pedal bracket 74 to pivot about the axis of the right pivot shaft 73. Each end of the right pedal bracket includes a pedal pivot nut 76. Two shoulder bolts 77 extend through the ends of the right pedal 25 and into the pedal pivot nuts 76. The right pedal 25 is able to spin freely about the pedal pivot shoulder bolts 77.

This combination of pivots permits the pedal two (2) degrees of freedom. This freedom is provided in order to allow the right pedal 25 to remain generally flat as it rotates about the axis of the right pedal shaft 58, wherein said axis may be inclined at an angle perpendicular to the working angle of the pedal tracks. The pivoting of the right pedal also allows the pedal surface to remain generally perpendicular to the user's leg as the user pushes the pedal out to the side. The right pedal 25 and left pedal 24 may both include identical hardware and components and may be mounted in the same manner and exhibit the same properties.

Figure 12:
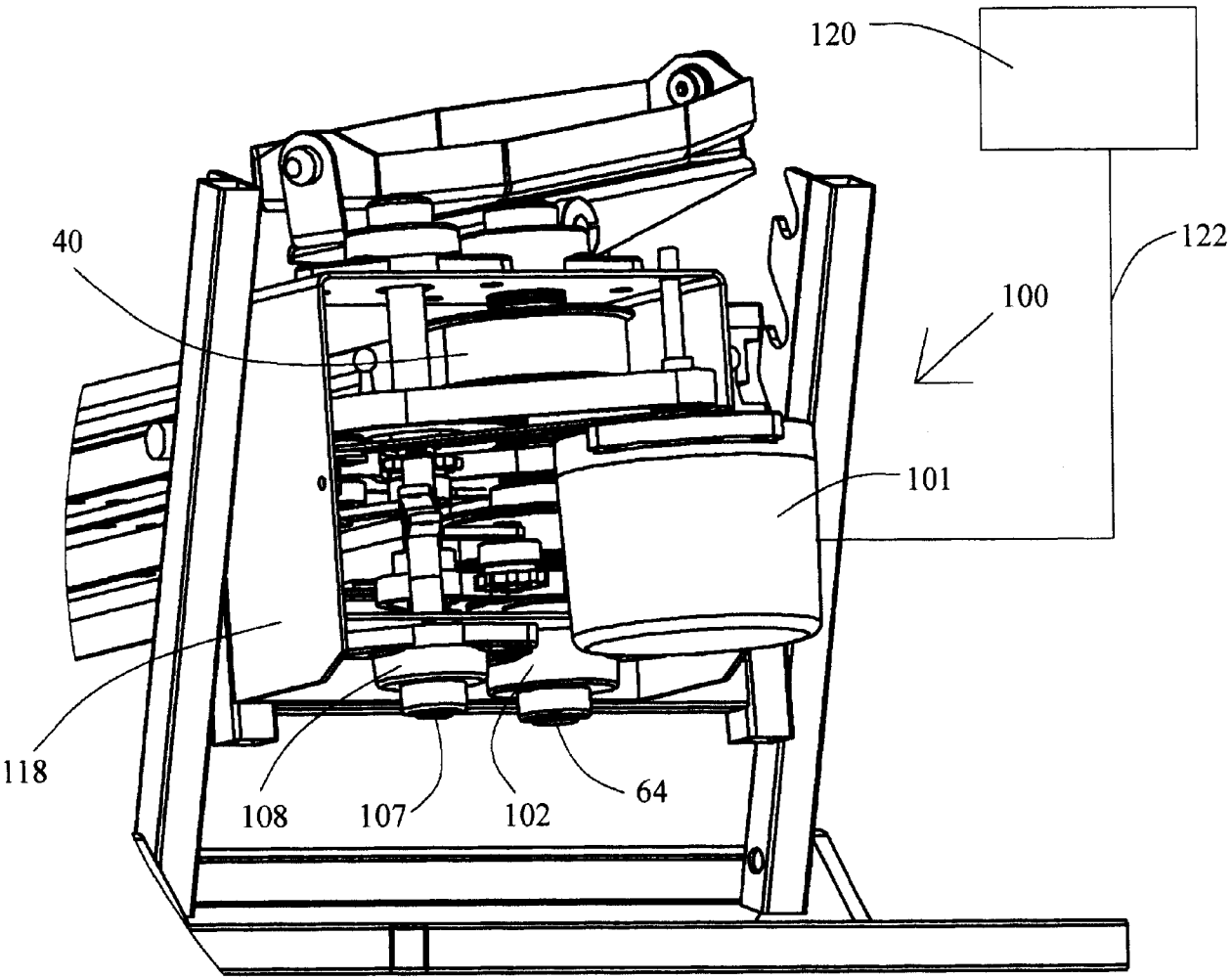
FIG. 12 is an enlarged isometric view of an embodiment of a drive system of the exercise apparatus of FIG. 1 with the handles removed.
Figure 13:
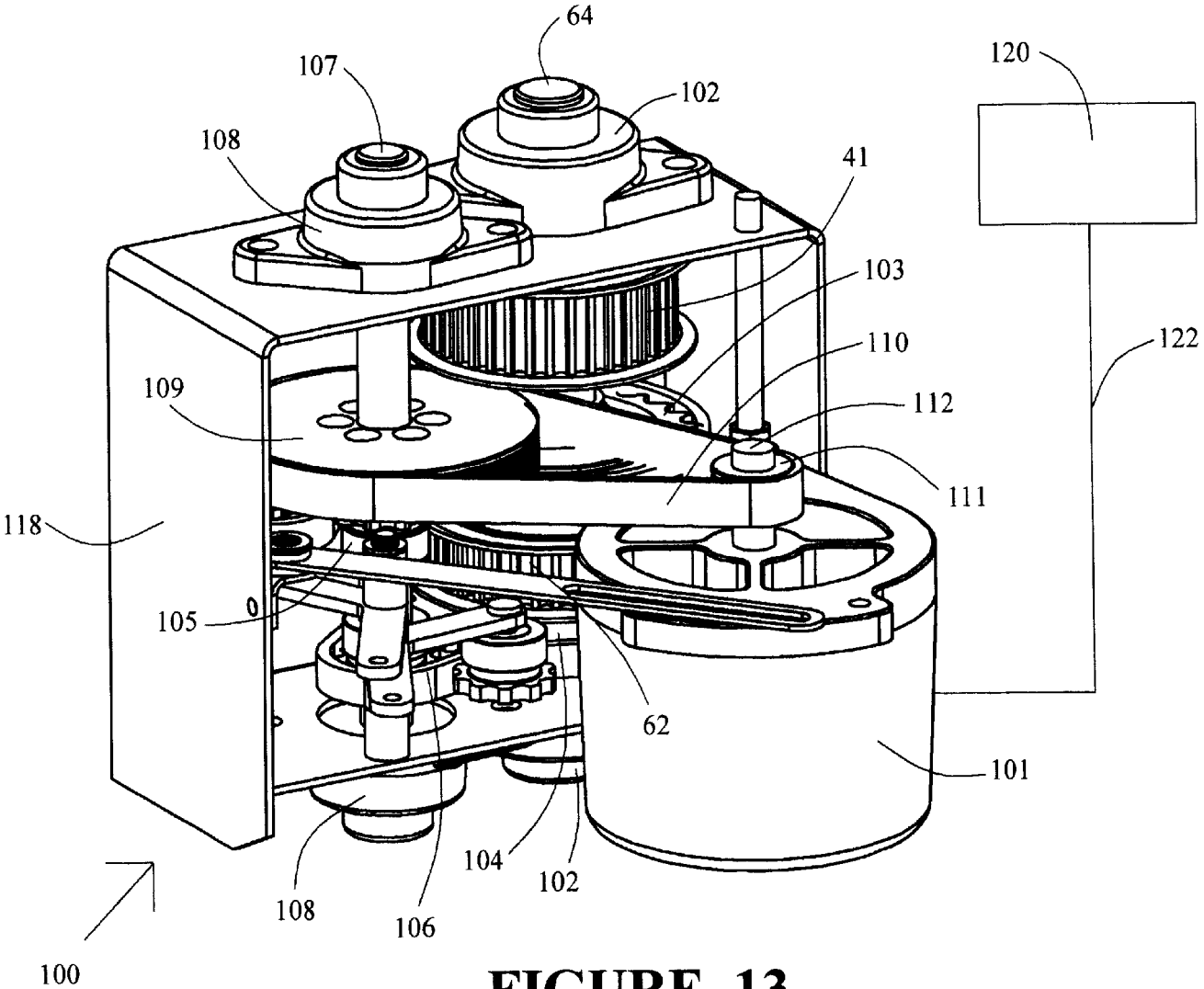
FIG. 13 is an enlarged upper isometric view of the drive system of FIG. 12.
Figure 14:
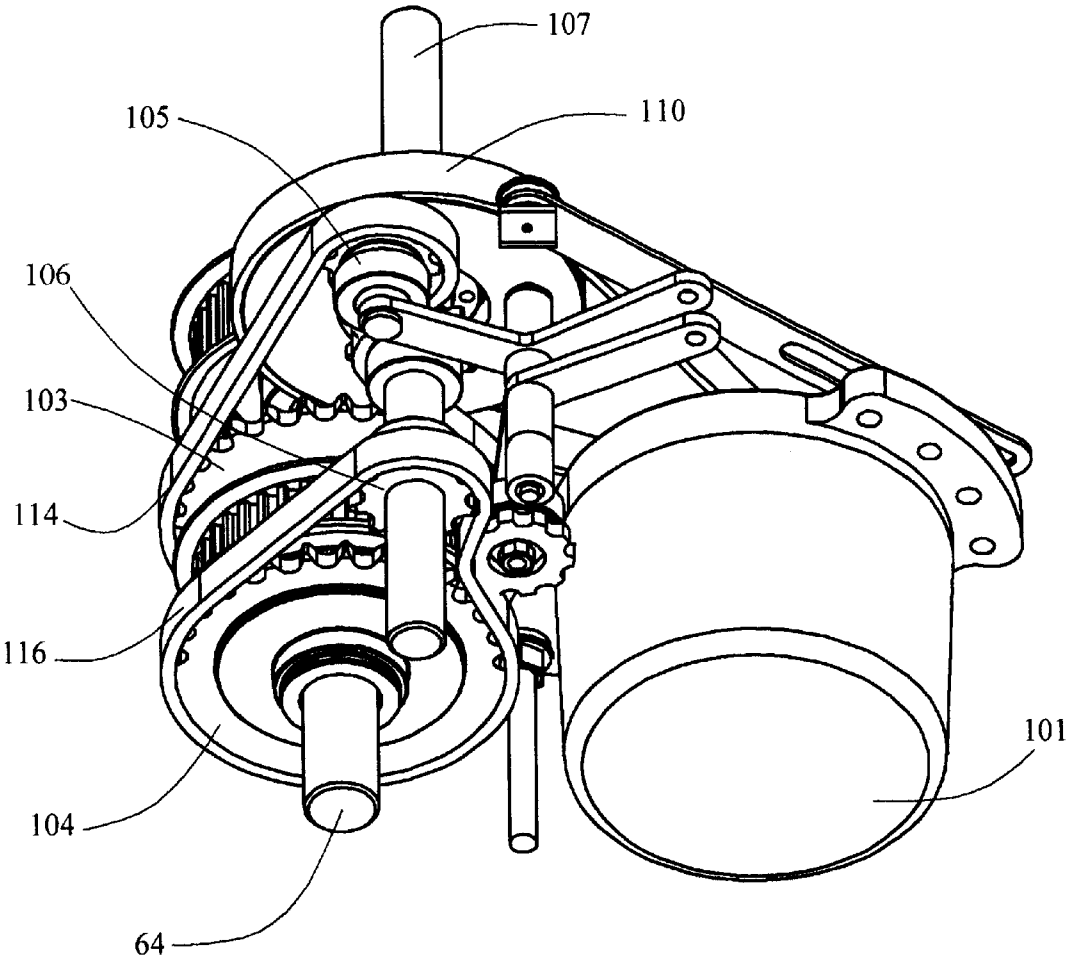
FIG. 14 is an enlarged lower isometric view of the drive system of FIG. 12.
Figure 15:
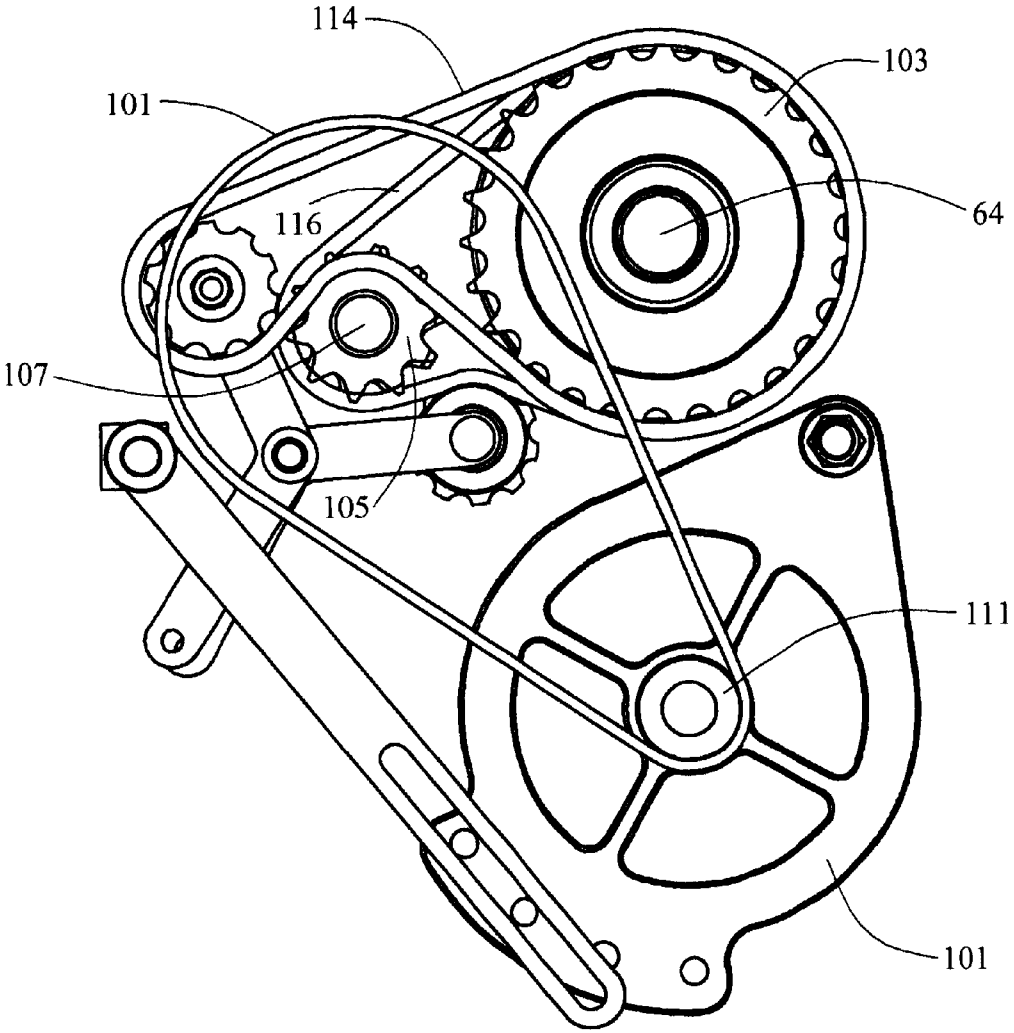
FIG. 15 is a top plan view of the drive system of FIG. 12.

FIGS. 12 and 13 are enlarged isometric views of a drive system 100 of the exercise apparatus 10 of FIG. 1. FIG. 14 is an enlarged lower isometric view, and FIG. 15 is a top plan view, of the drive system 100 of FIG. 12. In this embodiment, the drive system 100 provides resistance to the movement of the pedal mount assemblies 20, 21. Using the drive system 100, the work being done by the user may be regulated to a predetermined level. This may be desirable in an exercise product because different users may have a wide range of fitness levels. Movement of the pedal mount assemblies 20, 21 results in movement of the drive belt 40, which turns the drive pulley 41. The drive belt 40 does not move continuously in one direction, but rather, it reciprocates, reversing with each pedal stroke. The drive pulley 41 reciprocates correspondingly, rotating clockwise as the right pedal mount assembly 21 travels to the rear end 16 of the apparatus, then rotating counterclockwise as the left pedal mount assembly 20 travels to the rear end 16 of the apparatus. The drive pulley 41 is fixedly engaged to the input drive shaft 64. The input drive shaft 64 is rotatably mounted within a housing 118, top and bottom, by input bearings 102. Rotation of the drive pulley 41 results in a corresponding rotation of the input drive shaft 64.

As best seen in FIGS. 13 and 14, a CCW sprocket 103 and a CW sprocket 104 are mounted onto the input drive shaft 64 by means of one way clutches, as is known in the art. When drive shaft 64 rotates in the clockwise direction, the CCW sprocket 103 will spin freely and the CW sprocket 104 will be engaged with and driven in the clockwise direction with the input drive shaft 64. When the input drive shaft 64 rotates in the counter clockwise direction, the CW sprocket 104 will spin freely and the CCW sprocket 103 will be engaged and driven in the counterclockwise direction with the input drive shaft 64.

As best shown in FIG. 15, a first chain 114 is entrained around the CCW sprocket 103 and the CCW final drive sprocket 105. The first chain 114 is reverse wrapped around the CCW final drive sprocket 105. By reverse wrapping the first chain 114, the teeth of the CCW final drive sprocket 105 are engaged with the outside of the first chain 114. This causes the CCW final drive sprocket 105 to rotate in the opposite direction as the driving CCW sprocket 103. A second chain 116 is entrained around the CW sprocket 104 and the CW final drive sprocket 106. The second chain 116 is wrapped around the CW final drive sprocket 106 in the normal way. By normally wrapping the second chain 116, the teeth of the CW final drive sprocket 106 are engaged with the inside of the second chain 116. This causes the final drive sprocket 106 to rotate in the same direction as the driving CW sprocket 104. The CCW final drive sprocket 105 and the CW final drive sprocket 106 are both fixedly mounted to the final drive shaft 107. The final drive shaft 107 is rotatably mounted within the housing 118, top and bottom, by drive bearings 108.

In this embodiment, when the input drive shaft 64 is driven in the counterclockwise direction, the CCW sprocket 103 is engaged to rotate counterclockwise by the input drive shaft 64. When the CCW sprocket 103 rotates in the counterclockwise direction, the first chain 114 entrained thereabout turns the CCW final drive sprocket 105 in the clockwise direction. When the CCW final drive sprocket 105 turns in the clockwise direction, the final drive shaft 107 turns in the clockwise direction. When the input drive shaft 64 is driven in the clockwise direction, the CW sprocket 104 is engaged to rotate clockwise by the input drive shaft 64. Similarly, when the CW sprocket 104 rotates in the clockwise direction the second chain 116 entrained thereabout turns the CW final drive sprocket 106 in the clockwise direction. When the CW final drive sprocket 106 turns in the clockwise direction, the final drive shaft 107 turns in the clockwise direction. Thus, when the input drive shaft 64 rotates clockwise, the final drive shaft 107 turns clockwise, and when the input drive shaft 64 turns counterclockwise, the final drive shaft 107 turns in the same clockwise direction. Either way, the final drive shaft 107 rotates clockwise. Thus, the reciprocating rotation of the input drive shaft 64 is converted into unidirectional clockwise rotation of the final drive shaft 107.

As best shown in FIG. 13, a poly-v pulley 109 is fixedly engaged to final drive shaft 107. Clockwise rotation of the final drive shaft 107 causes clockwise rotation of the poly-v pulley 109. The poly-v belt 110 is entrained about the poly-v pulley 109 and an electromagnetic brake pulley 111. The electromagnetic brake pulley 111 is fixedly mounted to an electromagnetic brake input shaft 112. Rotation of the poly-v pulley 109 thereby causes rotation of an electromagnetic brake 101. Resistance applied to the rotation of the electromagnetic brake 101 thereby causes resistance to be exerted on the pedal mount assemblies 20, 21 which must be overcome by the user in order to cause the pedals 24, 25 to move through the skating exercise motion. In alternate embodiments, the electromagnetic brake 101 and its associated actuation components may be eliminated so that the resulting modified drive assembly does not resist the movement of the pedal mount assemblies 20, 21.

A controller 120 (FIGS. 12–13) is connected to the electromagnetic brake 101 by a conductive lead 122, and may be mounted in a convenient location, such as on one of the handles 17, 18. By varying the resistance applied by the electromagnetic brake 101 using the controller 120, the user can regulate the amount of force required to drive the pedals, and thus, the intensity of the exercise. Controllers of many types are commercially-available for controlling the resistance provided by the electromagnetic brake 101. Such controllers are known to those skilled in the art. Although the disclosed embodiment uses an electromagnetic brake 101, those skilled in the art will recognize that there are many types of resistance devices that can be used to controllably apply resistance to the pedals 24, 25.

The exercise apparatus 10 advantageously allows the user to adjust the operating characteristics, including skate/pedal stroke length and the amount of resistance of the pedal motion, while an exercise is in progress. This flexibility provides the user with a large degree of variability so that the user may exercise at a desired workout levels or at a variety of ranges of motion. The result is an exercise apparatus with improved construction and feel, and greater flexibility and ease of operation, which more closely simulates the natural skating movements over prior art devices.

Figure 16:
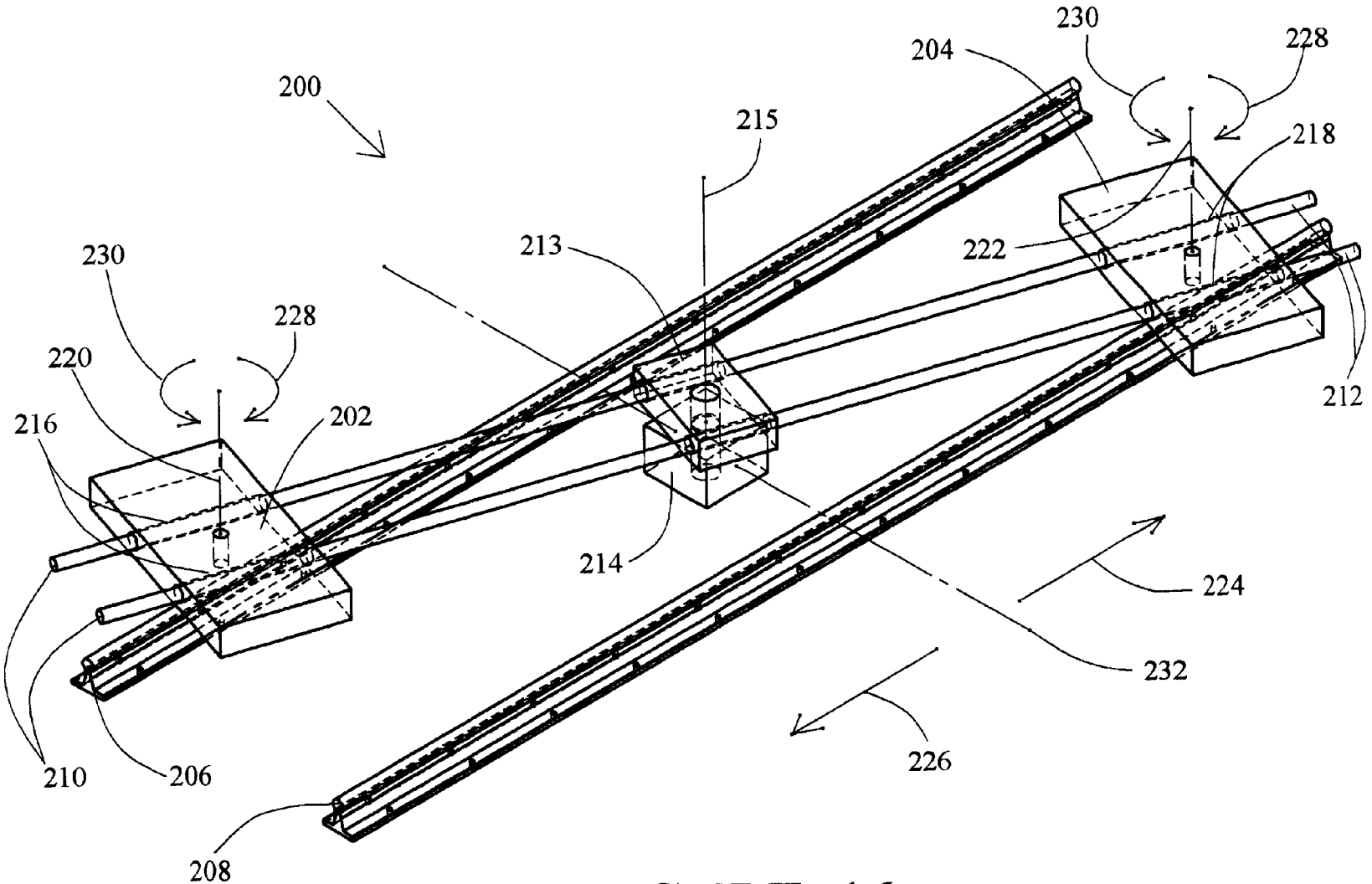
FIG. 16 is an upper isometric view of an exercise apparatus in accordance with an alternate embodiment of the invention.

FIG. 16 is an upper isometric view of an exercise apparatus 200 in accordance with an alternate embodiment of the invention. The exercise apparatus 200 includes first and second foot pads 202, 204 moveably mounted to first and second rails 206, 208, respectively. Pairs of first and second slide rods 210, 212 are rigidly coupled to a central support 213 that is rotationally attached to a main support 214. The central support 213 rotates about a main axis 215. The first and second slide rods 210, 212 project laterally from the central support 214 and are slideably engaged through pairs of first and second slide bores 216, 218 disposed through the first and second foot pads 202, 204, respectively. Each of the first and second foot pads 202, 204 is rotatable about a first and second axis 220, 222 that projects approximately normally through each respective foot pad 220, 222.

In operation, from an initial position shown in FIG. 16, the user's feet may be placed on the first and second foot pads 202, 204 to perform an exercise using the apparatus 200. As the user moves the first foot pad 202 in a first direction 224 along the first rail 206, the second foot pad 204 moves in a second direction 226 along the second rail 208. The first slide rods 210 slide into the first slide bores 216 and the second slide rods 212 slide into the second slide bores 218, rotating the first and second foot pads 202, 204 in a first rotational direction 228. As the first and second foot pads 202, 204 pass through a midline 232 of the apparatus 200, the first and second slide rods 210, 212 begin to slide back out of the first and second slide bores 216, 218. The first and second foot pads 202, 204 continue rotating in the first rotational direction 228.

When the first foot pad 202 reaches the end of its stoke in the first direction 224, the user may move the first foot pad 202 in the second direction 226, causing the second foot pad 204 to move in the first direction 224. The first and second slide rods 210, 212 again slide into the first and second slide bores 216, 218 and rotate the first and second foot pads 202, 204 in a second rotational direction 230 until the foot pads 202, 204 cross the midline 232, after which the slide rods 210, 212 begin to slide back out of the slide bores 216, 218. The first and second foot pads 202, 204 continue to rotate in the second rotational direction 230. The first foot pad 202 may return to its initial position to complete a cycle, and the process may be repeated as desired.

In this embodiment of the exercise apparatus 200, the rates of rotation of the first and second foot pads 202, 204 are not constant. The rotation rates of the first and second foot pads vary based on the positions of the foot pads along the first and second rails 206, 208. When the foot pads are close to the midline 232, the rotation rate of the pedals is higher than when the foot pads are spaced apart from the midline 232 toward the ends of the rails.

One may note that in the embodiment shown in FIG. 16, the first slide rods 210 (or the second slide rods 212) may be replaced with a single first (or second) slide rod. Also, although the first axis of rotation 220 is shown as projecting through the first foot pad 202 (and the second axis of rotation 222 projects through the second foot pad 204), in alternate embodiments, the foot pads may be designed to rotate about an axis of rotation that does not pass through the foot pad.

The exercise apparatus 200 advantageously provides the above-described flexibility of the skate/pedal stroke length while an exercise is in progress using a relatively simple design. Because the exercise apparatus 200 has fewer components, and because the components are relatively simple, the exercise apparatus 200 may be less expensive to construct and maintain. The exercise apparatus 200 may thereby provide the desired flexibility, ease of operation, and close simulation of the natural skating movements in an efficient, cost effective manner.

The detailed descriptions of the above embodiments are not exhaustive descriptions of all embodiments contemplated by the inventor to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other apparatuses and methods for exercising using skating motion, and not just to the embodiments described above and shown in the accompanying figures. Accordingly, the scope of the invention should be determined from the following claims.

What is claimed is:

1. An exercise apparatus, comprising:

left and right pedal guides;

left and right pedals moveably coupled to the left and right pedal guides, respectively, each of the left and right pedals having an axis of rotation projecting upward from an upper surface thereof;

a pedal control device coupled to the left and right pedals and constraining the movement of the left and right pedals such that as one of the left or right pedals is moved in a first direction along the left or right pedal guide, the other of the left or right pedals is moved in a second direction along the other of the left or right pedal guides; and wherein the pedal control device also constrains a rotational movement of the left and right pedals such that as the one of the left or right pedals is moved in the first direction, both the left and right pedals are simultaneously rotated in a first rotational direction about the axes of rotation, and as the other of the left or right pedals is moved in the first direction, both of the left and right pedals are simultaneously rotated in a second rotational direction about the axes of rotation.

2. The apparatus according to claim 1, further comprising a frame having a base portion and an upper portion, the left and right pedal guides being moveably attached to the upper portion.

3. The apparatus according to claim 2 wherein the upper portion is pivotably coupled to the base portion and the base portion includes an incline control member projecting upwardly therefrom, the upper portion being variably engageable with the incline control member to vary an inclination angle of the left and right pedal guides.

4. The apparatus according to claim 2 wherein the frame includes left and right handles engaged with the left and right pedal guides such the left handle moves with the left pedal and the right handle moves with the right pedal.

5. The apparatus according to claim 1 wherein the left and right pedal guides comprise substantially linear pedal guides.

6. The apparatus according to claim 1 wherein the left and right pedal guides include a substantially cylindrical rail member.

7. The apparatus according to claim 1 wherein each of the left and right pedals includes a substantially flat upper member adapted to be engageable with a foot of a user, the axis of rotation projecting upwardly from the upper member; and a mount assembly moveably coupled to the left or right pedal guide, respectively, and including a rotation shaft coupled to the upper member and aligned with the axis of rotation.

8. The apparatus according to claim 7, further comprising a first rotational member positioned proximate a forward end of the left and right pedal guides and a second rotational member positioned proximate a rearward end of the left and right pedal guides, and wherein the pedal control device includes a first coupling member attached to the left and right mount assemblies and operatively engaged about the first and second rotational members.

9. The apparatus according to claim 8 wherein the first coupling member comprises a belt and the first and second rotational members comprise first and second pulleys, respectively.

10. The apparatus according to claim 8 wherein the first coupling member comprises a chain and the first and second rotational members comprise first and second sprockets, respectively.

11. The apparatus according to claim 8, further comprising a third rotational member positioned proximate either the forward or rearward end, and wherein the pedal control device includes a second coupling member attached to the left and right rotational shafts and operatively engaged about the third rotational member.

12. The apparatus according to claim 11, further comprising a fourth rotation member positioned proximate the other of the forward or rearward end opposite from the third rotational member, and wherein the pedal control device includes a fourth coupling member attached to the left and right mount assemblies.

13. The apparatus according to claim 1 wherein the pedal control device includes a resistance device that resists the movement of the left and right pedals in at least one of the first and second directions.

14. The apparatus according to claim 13 wherein the resistance device comprises an electromagnetic brake.

15. The apparatus according to claim 13, further comprising a controller operatively coupled to the resistance device for providing a control signal which varies the resistance of the resistance device.

16. An exercise apparatus, comprising:

an elongated track member;

a pedal moveably coupled to the track member, the pedal being rotatable about an axis of rotation; and a pedal control assembly coupled to the pedal and controlling the movement of the pedal such that as the pedal is moved in a first direction along the track member, the pedal is rotated in a first rotational direction about the axis of rotation, and as the pedal is moved in a second direction along the track member, the pedal is rotated in a second rotational direction about the axis of rotation, wherein the pedal control assembly includes a resistance device that resists a movement of the pedal in at least one of the first and second directions.

17. The apparatus according to claim 16 wherein the elongated track member has a longitudinal axis, the axis of rotation being approximately normal to the longitudinal axis.

18. The apparatus according to claim 16 wherein the pedal includes a rotation shaft and the pedal control assembly includes a belt coupled to the rotation shaft, the belt at least partially wrapping around the shaft as the pedal moves in either the first or second directions, and at least partially unwrapping from the shaft as the pedal moves in the other of the first or second directions.

19. The apparatus according to claim 16 wherein the pedal control assembly rotates the pedal in at least one of the first and second rotational directions at a constant rotational rate.

20. The apparatus according to claim 16 wherein the pedal control assembly includes a slide rod rotatably coupled to a fixed support, the slide rod slideably engaging a slide bore disposed in the pedal.

21. The apparatus according to claim 20, further comprising an incline control assembly coupled to the track member that varies an incline angle of the track member.

22. The apparatus according to claim 20 wherein the track member comprises a first track member, the pedal comprises a first pedal, and the axis of rotation comprises a first axis of rotation, further comprising:

an elongated second track member proximate the first track member; and a second pedal moveably coupled to the second track member, the second pedal being rotatable about a second axis of rotation.

23. The apparatus according to claim 22 wherein the pedal control assembly is coupled to the second pedal such that as the first pedal is moved in the first direction along the first track member, the second pedal is moved in the second direction along the second track member.

24. The apparatus according to claim 22 wherein the pedal control assembly is coupled to the second pedal such that as the second pedal is moved in the second direction along the second track member, the second pedal is rotated in the first rotational direction about the second axis of rotation, and as the second pedal is moved in the first direction along the second track member, the second pedal is rotated in the second rotational direction about the second axis of rotation.

25. The apparatus according to claim 22 wherein the pedal control assembly comprises a first pedal control assembly, further comprising a second pedal control assembly coupled to the second pedal and controlling the movement of the second pedal such that as the second pedal is moved in the second direction along the second track member, the second pedal is rotated in the first rotational direction about the second axis of rotation, and as the second pedal is moved in the first direction along the second track member, the second pedal is rotated in the second rotational direction about the second axis of rotation.

26. An exercise apparatus, comprising:

an elongated track member;

a pedal moveably coupled to the track member, the pedal being rotatable about an axis of rotation;

a handle coupled to the track member, said handle moving with the pedal along the track member; and a pedal control assembly coupled to the pedal and controlling the movement of the pedal such that as the pedal is moved in a first direction along the track member, the pedal is rotated in a first rotational direction about the axis of rotation, and as the pedal is moved in a second direction along the track member, the pedal is rotated in a second rotational direction about the axis of rotation, wherein the pedal control assembly includes a slide rod rotatably coupled to a fixed support, the slide rod slideably engaging a slide bore disposed in the pedal.

27. The apparatus according to claim 26 wherein the pedal includes a rotation shaft and the pedal control assembly includes a belt coupled to the rotation shaft, the belt at least partially wrapping around the shaft as the pedal moves in either the first or second directions, and at least partially unwrapping from the shaft as the pedal moves in the other of the first or second directions.

28. The apparatus according to claim 26 wherein the pedal control assembly rotates the pedal in at least one of the first and second rotational directions at a constant rotational rate.

29. An exercise apparatus, comprising:

left and right tracks;

left and right pedals moveably coupled to the left and right tracks, respectively, each of the left and right pedals having an axis of rotation projecting upwardly therefrom;

a pedal control device coupled to the left and right pedals and constraining the movement of the left and right pedals such that as one of the left or right pedals is moved in a first direction along the left or right track, the other of the left or right pedals is moved in a second direction along the other of the left or right track, wherein the pedal control device also constrains a rotational movement of the left and right pedals such that as the one of the left or right pedals is moved in the first direction, both the left and right pedals are simultaneously rotated in a first rotational direction about the axes of rotation, and as the other of the left or right pedals is moved in the first direction, both of the left and right pedals are simultaneously rotated in a second rotational direction about the axes of rotation.

30. The apparatus according to claim 29 wherein at least one of the pedals includes a substantially flat upper surface and the axis projects perpendicularly from the upper surface.

31. A method of exercising, comprising:

providing an elongated first track member, a first pedal moveably coupled to the first track member, the first pedal being rotatable about an axis of rotation; and a pedal control assembly coupled to the first pedal and controlling the movement of the first pedal such that as the first pedal is moved in a first direction along the first track member, the first pedal is rotated in a first rotational direction about the axis of rotation, and as the first pedal is moved in a second direction along the first track member, the first pedal is rotated in a second rotational direction about the axis of rotation;

engaging a first foot with the first pedal moveably coupled to the first track;

moving the first pedal with the first foot in a first direction along the first track; and controllably rotating the first pedal in a first rotational direction as the first pedal is moving in the first direction, wherein controllably rotating the first pedal in a first rotational direction comprises controllably rotating the first pedal at a constant rate in the first rotational direction.

32. The method according to claim 31 wherein controllably rotating the first pedal in a first rotational direction comprises at least partially unwrapping a belt wound around a rotation shaft coupled to the first pedal.

33. The method according to claim 31 wherein controllably rotating the first pedal in a first rotational direction comprises at least partially sliding a rod through a bore disposed in the first pedal.

34. The method according to claim 31, further comprising moving a second pedal with a second foot in a second direction along a second track as the first pedal is moving in the first direction along the first track.

35. The method according to claim 31, further comprising controllably rotating a second pedal in the first rotational direction as the first pedal is controllably rotated in the first rotational direction.

36. The method according to claim 31, further comprising controllably adjusting a resistance force that resists the movement of the first pedal in the first direction along the first track.

37. A method of exercising, comprising:

providing an elongated first track member, a first pedal moveably coupled to the first track member, the first pedal being rotatable about an axis of rotation; and a pedal control assembly coupled to the first pedal and controlling the movement of the first pedal such that as the first pedal is moved in a first direction along the first track member, the first pedal is rotated in a first rotational direction about the axis of rotation, and as the first pedal is moved in a second direction along the first track member, the first pedal is rotated in a second rotational direction about the axis of rotation;

engaging a first foot with the first pedal moveably coupled to the first track;

moving the first pedal with the first foot in a first direction along the first track; and controllably rotating the first pedal in a first rotational direction as the first pedal is moving in the first direction, wherein controllably rotating the first pedal in a first rotational direction comprises at least partially unwrapping a belt wound around a rotation shaft coupled to the first pedal.

38. The method according to claim 37 wherein controllably rotating the first pedal in a first rotational direction comprises controllably rotating the first pedal at a constant rate in the first rotational direction.

39. The method according to claim 37 wherein controllably rotating the first pedal in a first rotational direction comprises at least partially sliding a rod through a bore disposed in the first pedal.

40. The method according to claim 37, further comprising moving a second pedal with a second foot in a second direction along a second track as the first pedal is moving in the first direction along the first track.

41. The method according to claim 37, further comprising controllably rotating a second pedal in the first rotational direction as the first pedal is controllably rotated in the first rotational direction.

42. The method according to claim 37, further comprising controllably adjusting a resistance force that resists the movement of the first pedal in the first direction along the first track.

* * * * *

UNITED STATES PATENT AND TRADEMARK OFFICE

CERTIFICATE OF CORRECTION

PATENT NO. : 6,514,180 B1
DATED : February 4, 2003
INVENTOR(S) : R. Lee Rawls

It is certified that error appears in the above-identified patent and that said Letters Patent is hereby corrected as shown below:

Title page,
Item [57], ABSTRACT,
Line 3, "for exercising using skating" should read -- for exercising using a skating --

Column 2,
Line 13, "cable-and-pully system." should read -- cable-and-pulley system. --

Column 4,
Line 17, "projects froward" should read -- projects forward --

Column 7,
Line 14, "built tracks which guide" should read -- build tracks which guide --

Column 11,
Line 24, "at a desired workout levels" should read -- at a desired workout level --

Column 12,
Line 50, "using skating motion," should read -- using a skating motion, --

Column 14,
Line 43, "according to claim 20," should read -- according to claim 16, --
Line 46, "according to claim 20" should read -- according to claim 16 --

Signed and Sealed this

Sixth Day of April, 2004

JON W. DUDAS
*Acting Director of the United States Patent and Trademark Office*